US007445564B2

(12) United States Patent
Kusumoto

(10) Patent No.: US 7,445,564 B2
(45) Date of Patent: Nov. 4, 2008

(54) GOLF CLUB HEAD

(75) Inventor: Harunobu Kusumoto, Higashikurume (JP)

(73) Assignee: Daiwa Seiko, Inc., Tokyo (JP)

( * ) Notice: Subject to any disclaimer, the term of this patent is extended or adjusted under 35 U.S.C. 154(b) by 267 days.

(21) Appl. No.: 11/091,406

(22) Filed: Mar. 29, 2005

(65) Prior Publication Data

US 2005/0221913 A1 Oct. 6, 2005

(30) Foreign Application Priority Data

Mar. 30, 2004 (JP) ..... 10-2004-098439
Mar. 31, 2004 (JP) ..... 10-2004-102469
Mar. 31, 2004 (JP) ..... 10-2004-102470

(51) Int. Cl.
*A63B 53/04* (2006.01)

(52) U.S. Cl. ..... 473/346; 473/348; 473/345

(58) Field of Classification Search ..... 473/324–350
See application file for complete search history.

(56) References Cited

U.S. PATENT DOCUMENTS 5,004,241 A * 4/1991 Antonious ..... 473/327
5,131,986 A * 7/1992 Harada et al. ..... 205/67
5,141,230 A * 8/1992 Antonious ..... 473/327
5,547,427 A * 8/1996 Rigal et al. ..... 473/345
6,945,877 B2 * 9/2005 Kobayashi et al. ..... 473/345
7,008,332 B2 * 3/2006 Liou ..... 473/345
7,163,470 B2 * 1/2007 Galloway et al. ..... 473/342

FOREIGN PATENT DOCUMENTS

JP 62-72670 5/1987
JP 07144033 A * 6/1995
JP 07144034 A * 6/1995
JP 7-98076 10/1995
JP 2001-204858 7/2001
JP 2002-113135 4/2002
JP 2002-219199 8/2002
JP 2003-111874 4/2003

* cited by examiner

*Primary Examiner*—Gene Kim
*Assistant Examiner*—Alvin A Hunter
(74) *Attorney, Agent, or Firm*—McGinn IP Law Group, PLLC

(57) ABSTRACT

A golf club head includes: a hollow shell head body that defines a face portion for hitting a ball and a crown portion; and a weight-massed portion that is formed on at least crown portion, wherein the weight-massed portion extends in a face-to-back direction of the head body and has a larger mass than that of a peripheral portion of the head body.

15 Claims, 15 Drawing Sheets

GOLF CLUB HEAD

BACKGROUND OF THE INVENTION

The present invention relates to a golf club head.

Generally, there has been known a golf club head in which a weight body is disposed in the interior of a hollow head in order to improve the directionality of a golf ball hit by the head. For example, in Patent Document 1, a golf club head is disclosed in which a weight body is placed at a position located at the rear of a crown portion and close to the axis of a club shaft in order to set the angle of the center of gravity of the head within a predetermined range (30.5 to 35 degrees). According to the golf club head like this, since a face side is made to rotate easily about the axis of the club shaft when a golf club is swung, the head is also made to easily turn, thereby making it possible to obtain an effect to prevent a slice shot. In addition, in Patent Document 2, a golf club head is disclosed in which a weight body is placed on a face side in the vicinity of a sweet spot. According to the golf club head like this, the player can sense the position of the sweet spot and the orientation of the clubface due to the concentration of the weight component on a single specific point on the head when swinging a golf club, thereby making it possible to obtain an effect to enable the player to easily hit the ball at a position close to the sweet spot.

Incidentally, as shown in FIG. 1, a swing of the golf club is made up of backswing from "the address" or setup (paths indicated by arrows A, B) to "the top of swing", the downswing (a path indicated by an arrow C) through the release of the cock of the wrists to the impact (a path indicated by arrow D), the follow through and the finish in this order. In this series of stages, during the backswing from the address, the clubface faces the front of the player as the grip of the club reaches the vicinity of the waist of the player, and during the stage of the downswing from the top, the clubface remains facing the front of the player until the grip returns to the vicinity of the waist of the player. Then, during the stage in which the grip moves from the vicinity of the waist of the player to the impact point, the so-called release of the cock of the wrists, the clubface is made to stay square to the path of the head in the downswing for impact. Namely, as shown in FIG. 2, in the path indicated by the arrow D, the player operates the club in such a manner as to rotate about the shaft axis X during the downswing thereof along a swing plane SP, so that the clubface becomes square to the ball at impact.

Thus, while the orientation of the head during the stage of releasing the cock of the wrists becomes vital with a view to eventually directing the clubface square to the target line of the ball at impact, an inertial force is exerted on the head during the swing, and in particular, with the aforesaid head construction according to the related art, since the weight body is concentrated at the single point (or is caused to reside at the single point), an inertial force is generated inherently by the weight body which resides at the single point.

While the aforesaid related techniques are such a technique that the orientation of the clubface is modified during the series of stages of the swing, no consideration is taken into on the inertial force so exerted on the head when the cock of the wrists is released. Namely, the inertial force generated by the weight component which resides at the single point needs to be dealt with by adding a certain force, and in the path indicated by the arrow D, the player needs to modify the orientation of the clubface in such a manner as to coincide with the direction of the swing plane through an operation of by, for example, twisting the wrists of the player, so that the clubface is eventually aligned squarely with the ball. Thus, with the related techniques, there is caused a problem that the techniques are inferior in an aspect of orienting the clubface square to the ball. As a result, in the related techniques, the swing tends to be easily destabilized during the path indicated by the arrow D due to the operation for controlling the inertial force generated by the weight component which is caused to reside at the single point in the head, and a certain swing technique is required to cope with the inertial force so generated so as to orient the clubface square to the ball, thus leading to a problem that the related techniques are inferior with respect to the stability (accuracy) of the direction of the ball hit.

In addition, in the golf club heads, it is generally known that the improvement in driving distance of a ball can be realized by reducing the loss of energy generated at impact by, in turn, making the deflection of the clubface coincide with the deformation of the ball at impact. For example, the deflection of the clubface at impact can be facilitated by making the clubface thinner, or the deflection of the clubface at impact can be facilitated by changing the thickness of the clubface (increasing the thickness of the ball hitting area, while decreasing the thickness of the peripheral area thereof).

In the case that the thickness of the clubface is decreased or changed, however, there is caused a problem that the clubface becomes easier to be damaged as the thickness thereof is decreased or changed.

Due to this, in Patent Document 3, there is disclosed a golf club head in which a material having a lower rigidity than that of a material used for a sole portion is used for a crown portion of a head body, so that the crown portion is deflected at impact so as to increase the driving distance. In addition, Patent Document 4 discloses a golf club head in which an opening is formed in a crown portion of a head body, so that a fiber-reinforced resin plate is fitted in the opening in such a manner as to make up the crown portion. In this construction, since the fiber-reinforced resin plate has a high specific strength, the center of gravity of the head can be lowered, which is effective in reducing the spin of the ball and increasing the angle of trajectory of the ball hit, thereby making it possible to increase the driving distance.

Since the golf club head disclosed in Patent Document 3 is constructed such that the whole of the crown portion is deflected, the energy generated at impact is transmitted to the rear of the crown portion in association with the deflection, and hence the energy is lost, whereby the properties of reaction become difficult to be improved, leading to a problem that the driving distance cannot be improved sufficiently. In addition, while the golf club head disclosed in Patent Document 4 can realize the lowering of the center of gravity by using the fiber-reinforced resin plate having the high specific strength, as with the construction disclosed in Patent Document 1, since the entirety of the crown portion is deflected, the loss of energy is caused, leading to the problem that the driving distance cannot be improved sufficiently. Furthermore, there is caused another problem that due to too small the hitting sound and too soft the hitting feeling, a hitting error becomes difficult to be sensed by the player.

Additionally, adjusting the weight of the head in the golf club head is generally known. For example, in Patent Document 5, there is disclosed a golf club head in which a nut which functions as a rough adjustment weight for roughly adjusting the weight of the head and a fine adjustment weight which is adapted to be screwed into a screw hole provided in a bolt adapted to be screwed into the nut are provided in a sole portion of a head body. Then, the swing weight is made to be adjusted by cutting part of the nut or selecting appropriate nut and weight from pluralities of nuts and fine adjustment weights prepared in advance which differ from one another in weight.

In addition, Patent Document 6 discloses a golf club head in which a weight is fixed to a sole portion while being exposed therefrom, so that an exposed portion of the weight is abraded for adjusting the weight of a head body.

The golf club head disclosed in Patent Document 5 is formed so as to adopt the technique to adjust the overall weight of the head and however has a problem that the position of the center of gravity thereof is difficult to be adjusted (a slight vertical weight adjustment is possible). In addition, as to the golf club head disclosed in Patent Document 6, while the overall weight of the head can be adjusted, the position of the center of gravity thereof is difficult to be adjusted, and there is possibly caused a risk that the external shape is changed depending upon the amount of abrasion, whereby the external appearance is defaced.

Namely, in manufacturing golf club heads, when the weight of a head becomes heavier than a designed weight, when the head needs to be re-adjusted after the completion of weight adjustment, or when the position of the center of gravity of the head needs to be adjusted finely in the toe-to-heel or face-to-back direction as well as the vertical direction, with the aforesaid related techniques, it is difficult to carry out the needed adjustments with ease and good accuracy.

Patent Document 1: JP-A-2002-113135
Patent Document 2: JP-A-2002-219199
Patent Document 3: JP-B-7-98076
Patent Document 4: JP-A-2003-111874
Patent Document 5: JP-A-62-72670U
Patent Document 6: JP-A-2001-204858

SUMMARY OF THE INVENTION

The invention was made based on the problems, and an object of the invention is to provide a golf club head which can stabilize the swing of a golf club to thereby realize the improvement in directional stability of a ball hit.

In addition, another object of the invention is to provide a golf club head in which a member having a higher specific strength than that of a head body is mounted in a crown portion of the head body so as not only to realize the lowering the center of gravity of the head but also to effectively reinforce the crown portion to thereby realize the improvement in the repulsion properties of a face portion.

Furthermore, a further object of the invention is to provide a golf club head which enables the weight adjustment of a head body with ease and good accuracy.

In order to solve the aforesaid object, the invention is characterized by having the following arrangement.

(1) A golf club head comprising:

a hollow shell head body that defines a face portion for hitting a ball and a crown portion; and a weight-massed portion that is formed on at least crown portion, wherein the weight-massed portion extends in a face-to-back direction of the head body and has a larger mass than that of a peripheral portion of the head body.

(2) The golf club head according to (1), wherein a length of the weight-massed portion as measured in the face-to-back direction on the crown portion corresponds to one third of a length of the crown portion as measured in the face-to-back direction.

(3) The golf club head according to (2), wherein the weight-massed portion is formed 5 mm or more rearward of a point of inflection between the crown portion and the face portion.

(4) The golf club head as set forth in (3), wherein the weight-massed portion is formed continuously from the crown portion to a sole portion.

(5) The golf club head according to (4), wherein the weight-massed portion is formed in such a manner as to follow a lie angle.

(6) The golf club head according to (4), wherein the weight-massed portion is formed to protrude towards a hollow space in the head body.

(7) The golf club head according to (6), wherein a number of hole portions are formed in the weight-massed portion.

(8) The golf club head according to (1), wherein the weight-massed portion is formed in such a manner as to curve to follow a swing plane when viewing the head body from the top thereof.

(9) A golf club head comprising:

a hollow shell head body that defines a face portion for hitting a ball, a crown portion having an opening, and a back portion;

a fiber-reinforced resin plate that closes the opening;

a support portion that bridges the opening so as to divide the opening in a face-to-back direction of the head body, and supports the fiber-reinforced resin plate; and a reinforcement portion that is formed at the support portion to extend from the back portion toward a vicinity of a center area of the opening and reinforces the fiber-reinforced resin plate.

(10) The golf club head according to (9), wherein the reinforcement portion is constituted by a rib integrally formed with the support portion.

(11) The golf club head according to (10), wherein the rib extends from the support portion toward a center area of a sole portion.

(12) The golf club head according to (10), wherein the reinforcement portion is formed in such a manner as to curve to follow a swing plane when viewing the head body from the top thereof.

(13) A golf club head comprising:

a hollow shell head body that defines a face portion for hitting a ball, a crown portion having an opening, and a back portion;

a fiber-reinforced resin plate that closes the opening; and a reinforcement portion that divides the opening in a face-to-back direction of the head body, extends from the back portion toward a vicinity of a center area of the opening and supports the fiber-reinforced resin plate.

(14) The golf club head according to (13), wherein a face member is held in the face portion and a thickness of a sole portion of the head body is smaller than that of the face member.

(15) A golf club head comprising:

a hollow shell head body that defines a face portion for hitting a ball; and a rib-shaped protruding portion that is formed inside the head body, wherein the protruding portion includes indented portions, raised portions and a through hole.

DESCRIPTION OF THE PREFERRED EMBODIMENTS

First Embodiment

Figure 1:
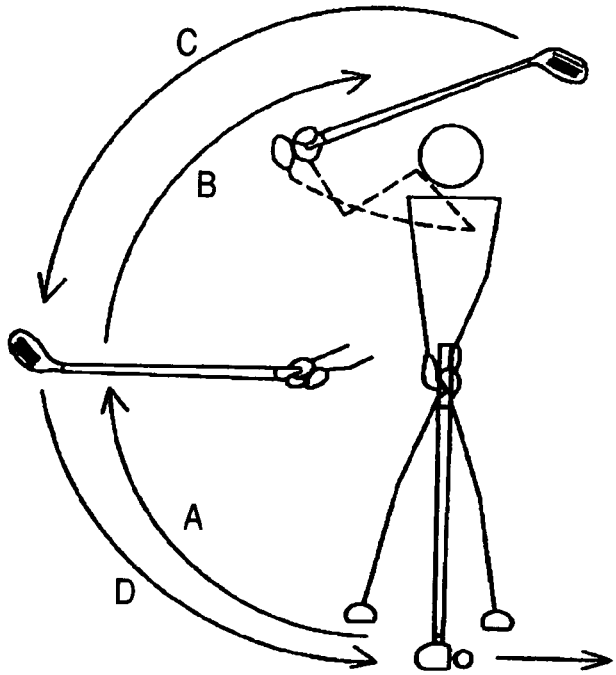
FIG. 1 is an exemplary drawing which explains a swing path.
Figure 2:
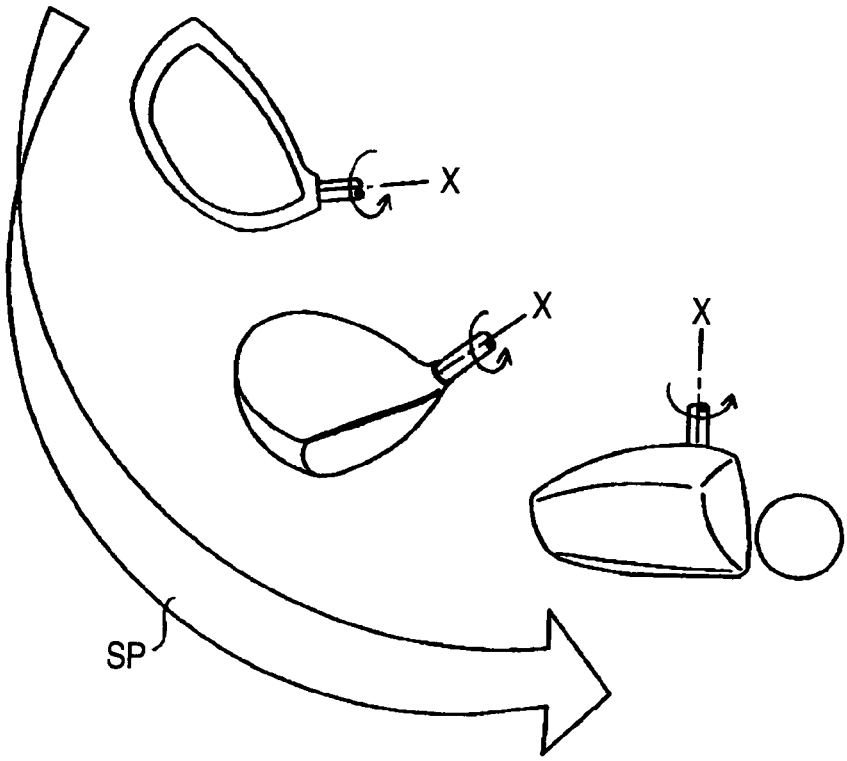
FIG. 2 is an enlarged view of part of the swing path shown in FIG. 1 accompanied by movements of a head.
Figure 3:
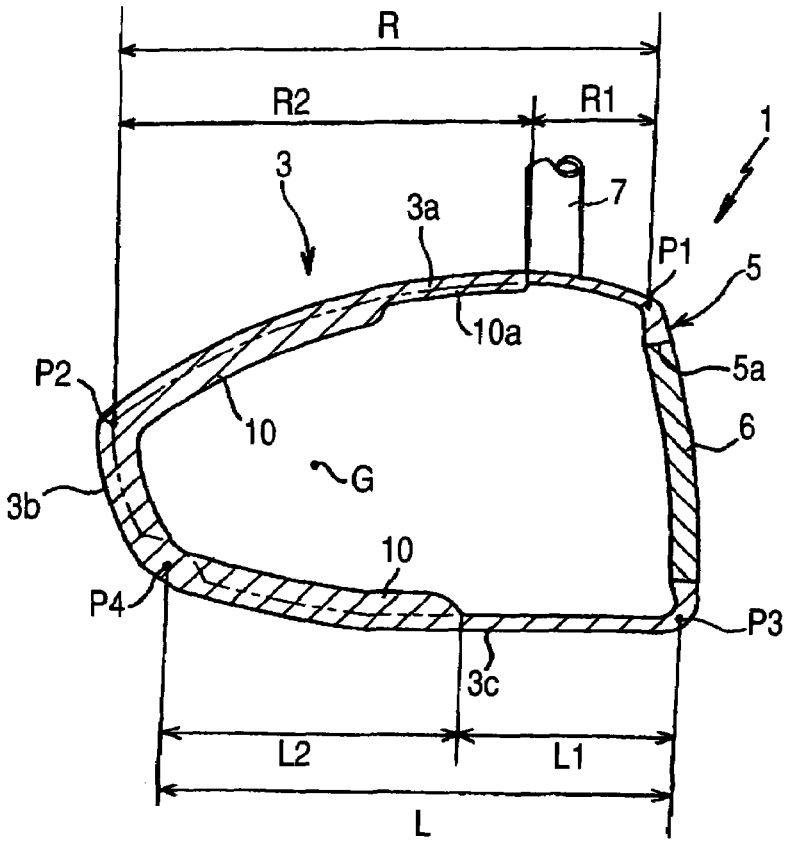
FIG. 3 is a drawing illustrating a first embodiment of a golf club head according to the invention, which is a longitudinal sectional view taken along a line passing through a position where the center of gravity of the head exists.
Figure 4:
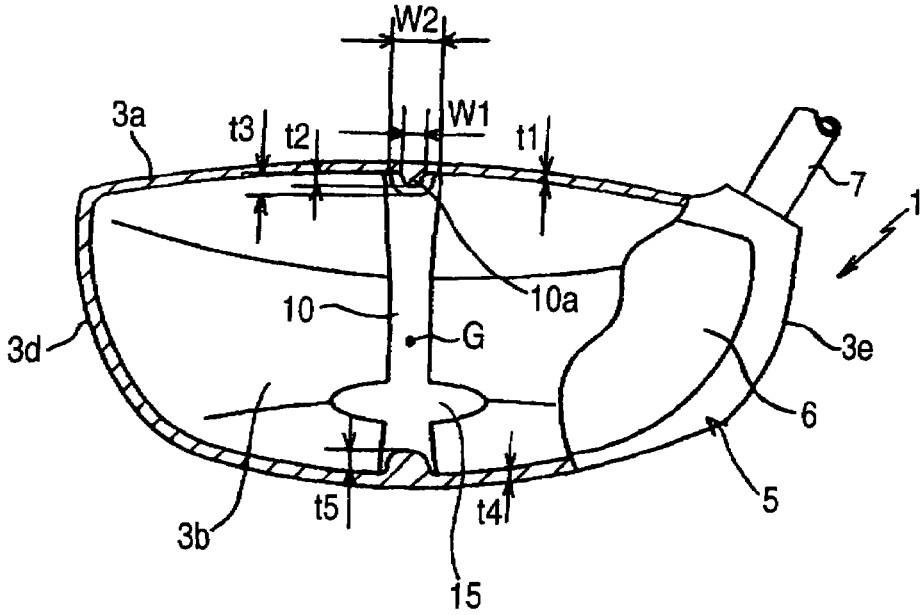
FIG. 4 is a transverse sectional view of the head shown in FIG. 1, taken on a face side thereof.
Figure 5:
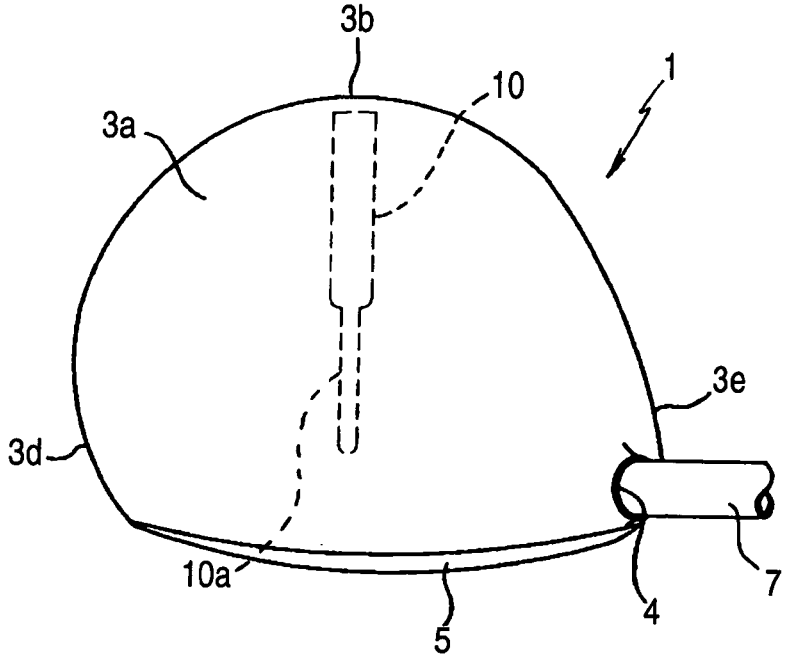
FIG. 5 is a plan view of the head shown in FIG. 1.
Figure 6:
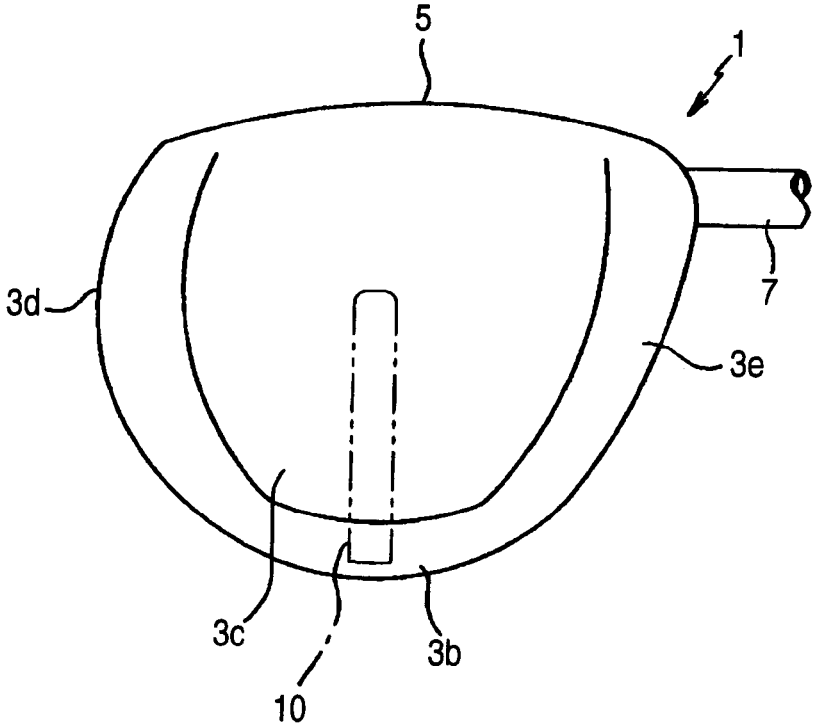
FIG. 6 is a bottom view of the head shown in FIG. 1.

FIGS. 3 to 6 show a golf club head according to a first embodiment of the invention, in which FIG. 3 is a longitudinal sectional view taken along a line passing through a position where the center of gravity of a head exists, FIG. 4 is a transverse sectional view taken on a face side of the head, FIG. 5 is a plan view of the head, and FIG. 6 is a bottom view of the head.

A head body 1 of a golf club head (hereinafter, referred to as a head) according to the first embodiment includes a rear member 3 which is made up, in turn, of a crown portion 3*a*, a back portion 3*b*, a sole portion 3*c*, a toe portion 3*d* and a heal portion 3*e*, and a front member (a face portion) 5 which is welded to or integrated into the rear member 3. Then, an opening 5*a* is formed in the face portion 5, and a face member 6 is securely held in the opening via welding, press fitting or bonding, whereby the head body 1 is constructed into a hollow shell structure.

Note that all of the shell members of the head body 1 of the embodiment except for the face member 6 are molded into a single unit through casting, and the face member 6, which is formed via blanking, is then securely held in the opening 5*a*. In this case, the rear member 3 and the front member 5 excluding the face member 6 are made of, for example, stainless steel, stainless steel alloy, titanium, titanium alloy or the like, and the face member 6 is made of, for example, titanium alloy having a large specific strength. In addition, a shaft holding hole 4 is formed in the crown portion 3*a* of the head body 1, and a shaft 7, which is made of metal or FRP, is securely fitted in the shaft holding hole 4 so formed towards a hollow space in the head body 1.

A weight-massed portion 10 is provided integrally on the crown portion 3*a*, the back portion 3*b* and the sole portion 3*c*. This weight-massed portion 10 is a portion where a larger mass than that of a peripheral portion of the head body 1 is concentrated or massed and is designed not to concentrate the weight at a specific point but to impart the directionality to the weight component by being formed in such a manner as to extend in a face-to-back direction of the head body or a direction along a swing plane (in this embodiment, a rearward direction normal to the face portion 5). In this embodiment, as shown in the drawings, the weight-massed portion 10 is formed into a rib shape which protrudes towards a center side of the hollow space.

In this case, the weight-massed portion 10 is preferably formed at a position which passes through the center of gravity G of the head body 1 in order to obtain a function and effect of the most stable motion properties during the swing and is formed so as to have a predetermined thickness and height. In addition, the weight-massed portion 10 is preferably formed on rear parts of the crown portion 3*a* and the sole portion 3*c* rather than over the entirety thereof in the face-to-back direction. Namely, by maintaining areas of the crown portion 3*a* and the sole portion 3*c* just behind the face portion 5 thin, a rear area of the face member 6 is made to easily deflect so as to increase the deflection amount of the face when hitting the ball to thereby improve the reaction performance, thereby making it possible to improve the driving distance.

To be specific, as shown in the drawing, the area R1 on the crown portion 3*a* where the rib-shaped weight-massed portion 10 is not formed preferably extends 5 mm or greater from a point of inflection P1, which will be defined as below, in order to secure a sufficient deflection area. In addition, as shown in the drawing, in a case where the weight-massed portion 10 is formed continuously on the sole portion 3*c* via the back portion, as with the crown portion 3*a*, the area L1 where the weight-massed portion 10 is not formed preferably extends 5 mm or greater from a point of inflection P3, which will be defined as below, in order to secure a sufficient deflection area.

Then, assuming that a length of the crown portion 3*a* in the face-to-back direction is R, the length (shown as R2 in the drawing) of the weight-massed portion 10 formed on the crown portion is preferably one third of the R or greater. Namely, by forming the weight-massed portion 10 to extend over such an extent, the alignment of mass along the direction of hitting the ball is made clear, whereby the rotation of the shaft about the shaft axis is made to be easily directed towards the inertial force exerted on the head during the swing. In addition, as to the length (shown as L2 in the drawing) of the weight-massed portion 10 formed on the sole portion 3*c*, for the same reason as that for the crown portion 3*a*, when assuming that a length of the sole portion 3*c* in the face-to-back direction is L, the length of the weight-massed portion 10 is preferably one third of the L or greater.

Note that in consideration of the section shown in FIG. 3 as taken along the line passing through the center of gravity G, the face-to-back length R of the crown portion 3*a* is defined as an area on the crown portion 3*a* whose radius of curvature is greater than 80 mm and is specified by a distance between points of deflection P1, P2 where the radius of curvature decreases to 80 mm or smaller. Similarly, in consideration of the section shown in FIG. 3 as taken along the line passing through the center of gravity G, the face-to-back length L of the sole portion 3*c* is defined as an area on the sole portion 3*c* whose radius of curvature is greater than 80 mm and is specified by a distance between points of deflection P3, P4 where the radius of curvature decreases to 80 mm or smaller.

While the aforesaid weight-massed portion 10 may be formed in the same thickness and height altogether, the height and thickness may be changed partially. For example, as shown in the drawing, the thickness W1 of a predetermined area 10*a* on the crown portion 3*a* which is located on the face side may be made thinner than the thickness W2 of an area on the crown portion 3*a* which is located rearward of the area 10*a*, and the height t2 of the area 10*a* may be lower than the height t3 of the area rearward of the area 10*a*. By adopting the construction like this, the rigidity of the crown portion 3*a* decreases on the face side, and this facilitates the deflection of the face portion, thereby making it possible to realize the improvement in the repulsion properties against the ball. In addition, since the rigidity changes step by step, there can be eliminated a risk that the face portion fails due to stress concentration.

In addition, the mass of the weight-massed portion 10 or, assuming that of the thickness of the shell structure of the head body, the thickness of the crown portion is t1 and the thickness of the sole portion is t4, the weight of the portions which protrude from those thicknesses preferably occupies 5 to 30% of the overall weight of the head (the weight of the head body 1 with the shaft 7 being removed in the drawing). Namely, the reason why the weight of the weight-massed portion 10 is set to fall within the range is because in the case that the relevant weight is made to occupy a ratio lower than 5%, the feeling of heavy weight becomes difficult to be sensed by the player during the swing, and the effect to make the shaft rotation follow the inertial force cannot be exhibited sufficiently, whereas in the case that the weight of the weight-massed portion 10 is made to occupy a ratio greater than 30%, the overall balance of the head is collapsed.

Specifically, the thicknesses (widths) W1 and W2 shown in FIG. 4 are made to fall within a range of 1.0 to 8.0 mm, and the heights t2, t3 and t5 within a range of 1.0 to 15.0 mm, so that the weight-massed portion 10 becomes thicker (taller) than the portion (the shell structure) which surrounds it and as narrow as possible, whereby a clear distinction is realized between the weight-massed portion 10 and the peripheral portion. Thus, the weight-massed portion 10 is set such that the degree of weight concentration increases. Namely, by increasing the degree of weight concentration, the effect to make the shaft rotation follow the inertial force can be increased.

The thickness of the shell structure excluding the weight-massed portion is preferably made to be thinner than the weight-massed portion and to become uniform. Namely, since the concentration of a weight changing portion, which results from a change in thickness, at a single point is eliminated by making the thickness of the shell structure uniform, it becomes possible to make it difficult to cause a wobble during the swing. Note that a weight body 15 may be disposed at any position in the interior of the head for the purpose of adjusting the position of the center of gravity. This weight body 15 may be formed as an integral part of the weight-massed portion 10 at a position where the heavy weight is prevented from being concentrated at a single point, or, for example, as shown in FIG. 4, at a boundary portion between the weight-massed portion 10 and the shell structure (a boundary position between the sole portion and the back portion), in light of the overall construction of the head. By adopting this construction, the properties of making the shaft rotation follow the inertial force are not affected and at the same time, a deep center of gravity position and a large inertial moment around the center of gravity can be obtained, thereby making it possible to provide a golf club which can provide a high trajectory and a large sweet area.

According to the golf club head that has been described heretofore, since the weight-massed portion is not concentrated at any specific position in the head body but is provided in such a manner as to extend in the face-to-back direction or the direction of the swing plane, in the flow of the series of swing stages, and in particular, when the cock of the wrists is released, the rotation of the shaft about the shaft axis can easily be made to follow the inertial force exerted in the direction of the swing plane without any additional operation. In particular, since the weight-massed portion 10 is disposed at the position which passes through the center of gravity G of the head, the rotation of the shaft is allowed to be made to follow the inertial force more easily. As a result, when the cock of the wrists is released, the swing can be stabilized without twisting operation of the wrists such that the clubface is easily directed to face square to the ball hitting direction, whereby the scattering of the ball hitting point is prevented at the point of impact, the direction of the ball hit being thereby stabilized. Furthermore, since the weight-massed portion 10 is made to be sensed easily by the player, there is also provided an effect that the ball hitting point is hard to be scattered along the toe-to-heel direction.

In addition, since the weight-massed portion is not formed in the area just behind the face portion 6 but the thin areas are secured on the crown portion 3*a* and the sole portion 3*c* just behind the face portion 6, the deflection effect can be obtained at the point of impact, thereby making it possible to realize the improvement in driving distance of the ball. Furthermore, since the weight-massed portion is formed in such a manner as to extend from the crown portion 3*a* as far as the sole portion 3*c*, the rigidity of the rear part of the head body 1 is improved so as to increase the deflection of the face portion to thereby realize the improvement in repulsion properties. In addition, the vertical (crown-to-sole) balance of the head is improved, and hence the wobble during the swing is hard to occur and the properties of making the shaft rotation follow the inertial force are improved. Additionally, since the vertical inertial moment about the center of gravity is increased at the same time, there can be provided a golf club which is superior with respect to the suppression of a vertical deflection of the hitting point.

In addition, according to the construction that has been described heretofore, since the weight-massed portion 10 is constructed into the rib shape which is made to protrude towards the center side of the hollow space in the head body 1, the weight-massed portion 10 extends along the swing plane in such a state that the weight body is aligned along the vertical direction of the hollow space in the head body, whereby the properties of making the shaft rotation follow the inertial force are improved, and the mass distribution of the weight body can be sensed more easily by the player, thereby making it possible to stabilize the swing.

Figure 7:
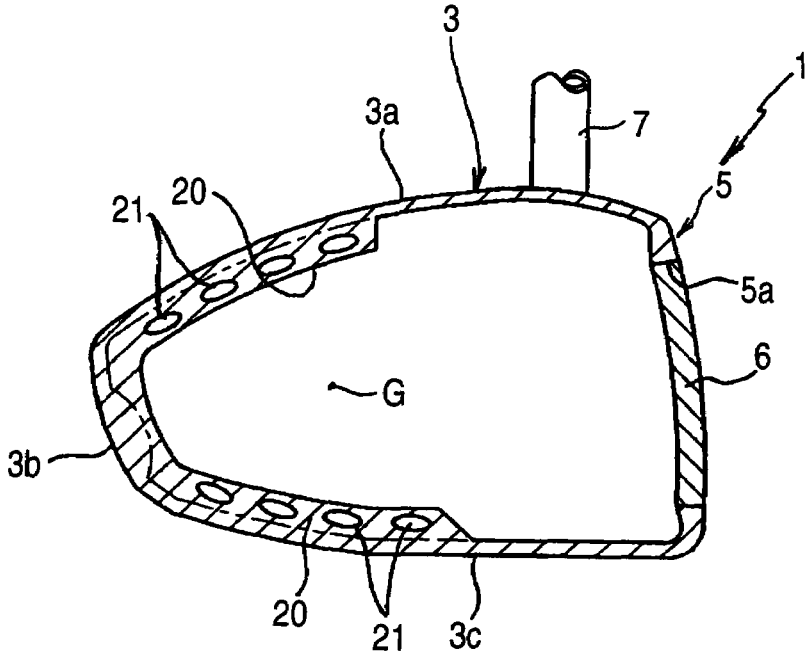
FIG. 7 is a longitudinal sectional view of a first modification according to the invention.

Note that in this case, as shown in FIG. 7, by forming a number of hole portions 21 in a weight-massed portion 20 which is formed into a rib shape, the rib can be formed taller at the same weight ratio, whereby the improvement in the weight distribution effect along the vertical direction of the weight body can be realized. Then, this improves further the properties of making the shaft rotation follow the inertial force during the swing, thereby making it possible to realize the stabilization of the swing.

Second Embodiment

Figure 8:
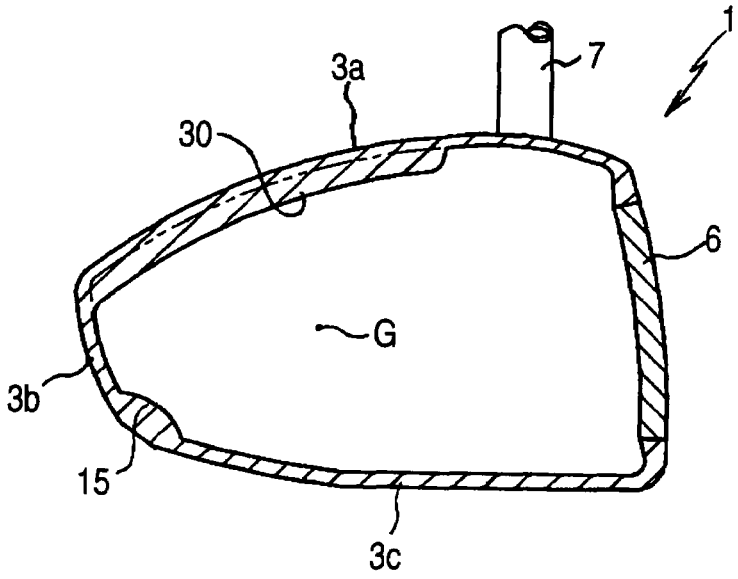
FIG. 8 is a drawing illustrating a second embodiment of a golf club head according to the invention, which is a longitudinal sectional view taken along a line passing through a position where the center of gravity of the head exists.
Figure 9:
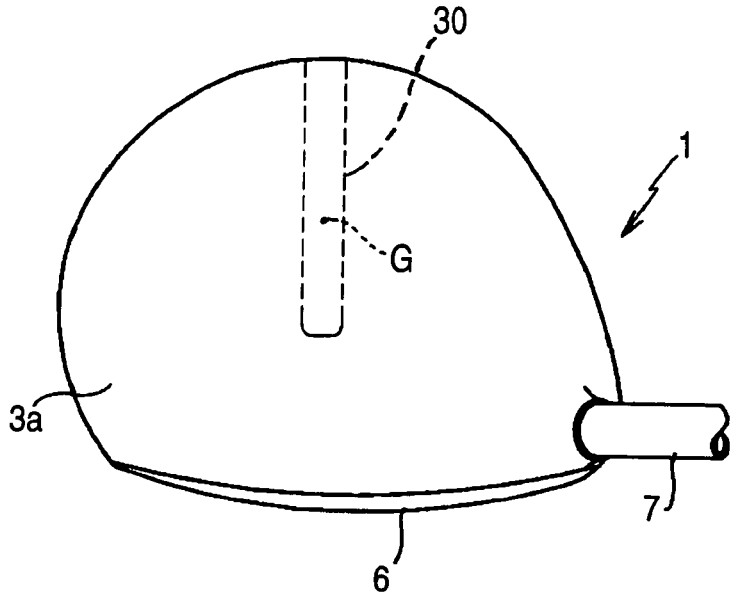
FIG. 9 is a plan view of the head shown in FIG. 8.

FIGS. 8 and 9 are such as to illustrate a second embodiment of the invention, in which FIG. 8 is a longitudinal sectional view of a golf club head taken along the line which passes through the center of gravity of the head and FIG. 9 is a plan view of the head.

In the embodiment that has been described before, while the weight-massed portion 10 is formed in such a manner as to extend continuously from the crown portion 3*a* to the sole portion 3*c* of the head body 1, a weight-massed portion 30, which extends in the face-to-back direction as shown in the drawings, may be formed only on a crown portion 3*a*. Namely, in heads of a hollow construction, in general, the sole portion tends to be made relatively heavy with a view to realizing a low center of gravity, and the crown portion tends to be formed relatively thin due to no adjustment being made for the center of gravity. Due to this, by forming the weight-massed portion 30 on the crown portion which constitutes the thin portion, the weight body is allowed to be easily sensed by the player.

Third Embodiment

Figure 10:
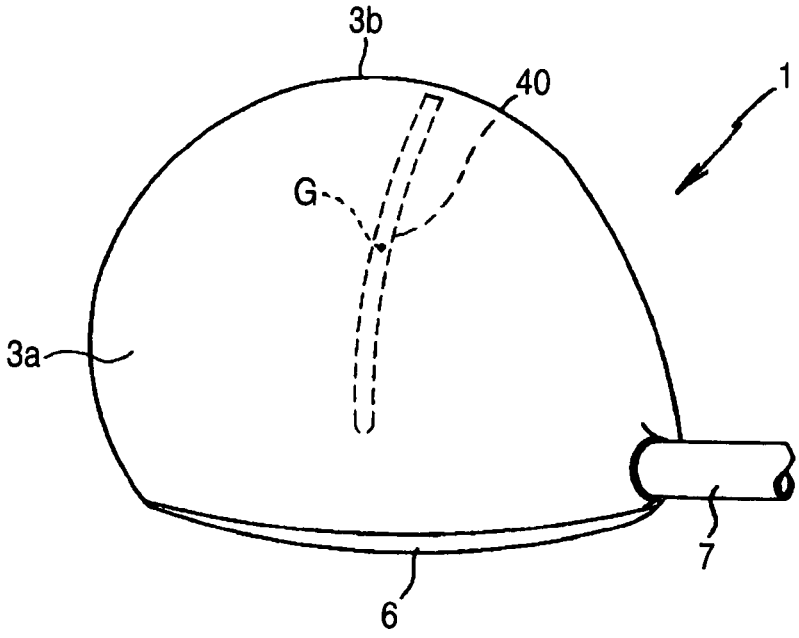
FIG. 10 is a drawing illustrating a third embodiment of a golf club head according to the invention, which is a plan view of the head.
Figure 11:
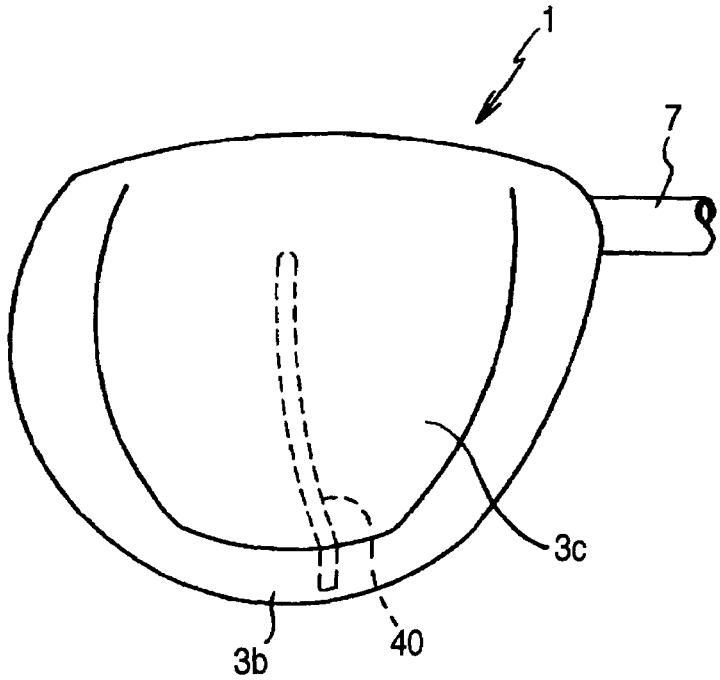
FIG. 11 is a bottom view of the head shown in FIG. 10.

FIGS. 10 and 11 are such as to illustrate a third embodiment of the invention, in which FIG. 10 is a plan view of a golf club head and FIG. 11 is a bottom view of the head.

While in the embodiments that have been described before, the weight-massed portions are formed in the direction normal to the face portion of the head, a weight-massed portion 40 according to this embodiment is formed in such a manner as to curve along the swing plane when a head body 1 is seen from the top. Namely, by forming the weight-massed portion 40 in such a manner as to so curve, the effect to make the shaft rotation follow the direction of the swing plane can be increased further, whereby the swing is made difficult to deflect and stable. In particular, an effect to make the turn of the head follow the direction of the swing plane is increased to thereby facilitate the shot of a draw ball (a ball path which slightly curves from the right to the left). As this occurs, in the event that a weight-massed portion is also formed on a sole portion 3*c*, the weight-massed portion is preferably formed in such a manner as to curve similarly along the direction of the swing plane as shown in FIG. 11.

Note that the radius of curvature of the curved weight-massed portion may be formed in a range of 500 to 2000 mm in consideration of a difference in swing plane depending on players. In the event that the radius of curvature is decreased, the effect to make the turn of the head follow the direction of the swing plane is intensified, whereby the ease with which a draw ball is shot is improved. In addition, as with the embodiments described before, the weight-massed portion 40 is preferably formed at the position which passes through the center of gravity G of the head.

Fourth Embodiment

Figure 12:
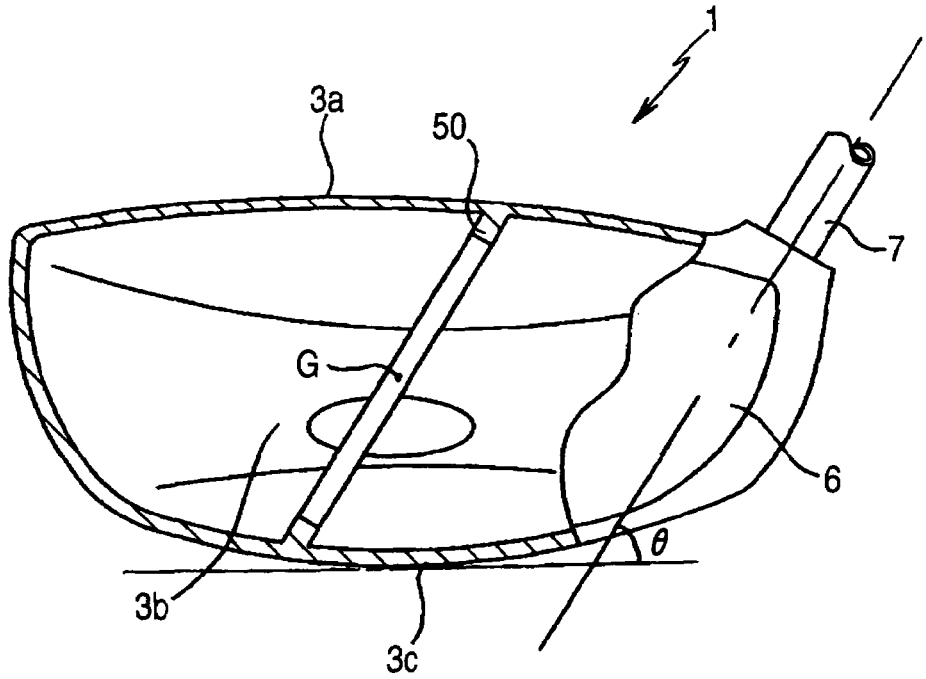
FIG. 12 is a drawing illustrating a fourth embodiment of a golf club head according to the invention, which is a transverse sectional view, taken on a face side thereof.

FIG. 12 is a drawing illustrating a fourth embodiment of the invention, which illustrates a transverse sectional view of a head taken on a face member side thereof.

Figure 13:
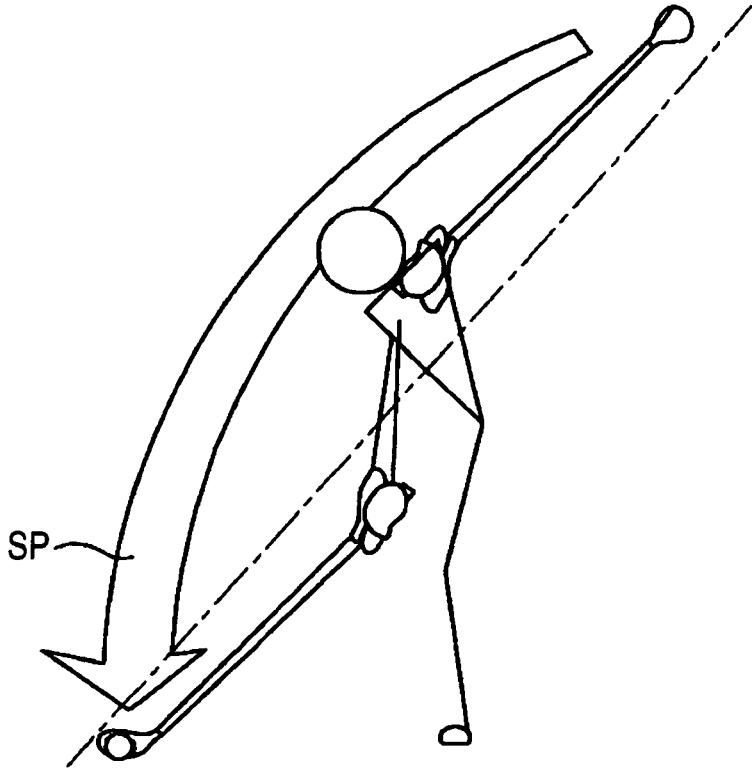
FIG. 13 is an exemplary view of a swing by a player as viewed from a direction square to the front of a ball to be hit.

Normally, when the player swings the golf club, a resulting swing plane SP inclines as indicated by a chain line in an exemplary view of FIG. 13, and an inclination angle formed then substantially corresponds to the lie angle θ of the golf club (an angle formed by a club shaft 7 and the horizontal surface when the club is set such that the clubface of the head is directed square to the ball with the sole portion touching the ground). Due to this, by forming a weight-massed portion 50 to incline from a crown portion 3*a* to a sole portion 3*c* in such a manner as to correspond to the lie angle θ of the head body, as shown in FIG. 12, the improvement in the properties of making the shaft rotation follow the direction of the swing plane can be realized, and a force is generated in the vertical weight-massed portion 50 by virtue of a centrifugal force generated during the swing in such a manner as to be exerted in a direction parallel to the swing plane, whereby the head can easily be directed into a stable state (a state of the head resulting when an appropriate impact is attained).

Thus, while the embodiments of the invention have been described heretofore, the invention can be modified variously with respect to the overall shape, material and method of forming the head body, provided that the weight-massed portion is provided on at least the crown portion of the head body of the hollow shell construction in such a manner as to extend over the predetermined length.

Figure 14:
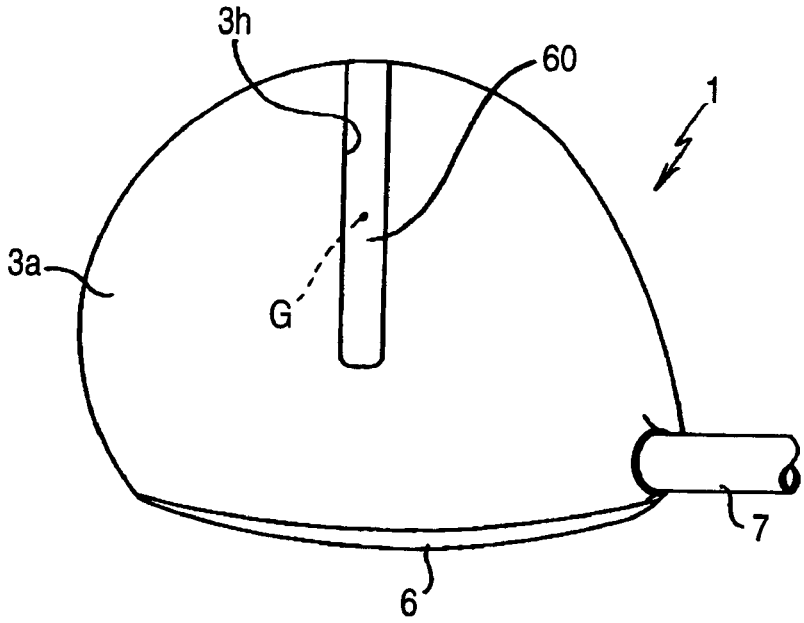
FIG. 14 is a drawing illustrating a second modification of the invention.

In addition, the weight-massed portion may be such as to be formed integrally with the shell members which constitute the head body through casting or may be formed as a separate member to be mounted on the crown portion. For example, as shown in FIG. 14, an opening 3*h* (an elongated hole) is formed in the crown portion 3*a* in such a manner as to extend in the face-to-back direction, and a weight-massed portion 60, which is made of a material having a larger specific gravity than that of the shell members constituting the head body, may be fixedly fitted in the opening 3*h*. In addition, in this construction, the weight-massed portion 60 may be constructed in the same thickness as that of the shell members of the head body.

Figure 15:
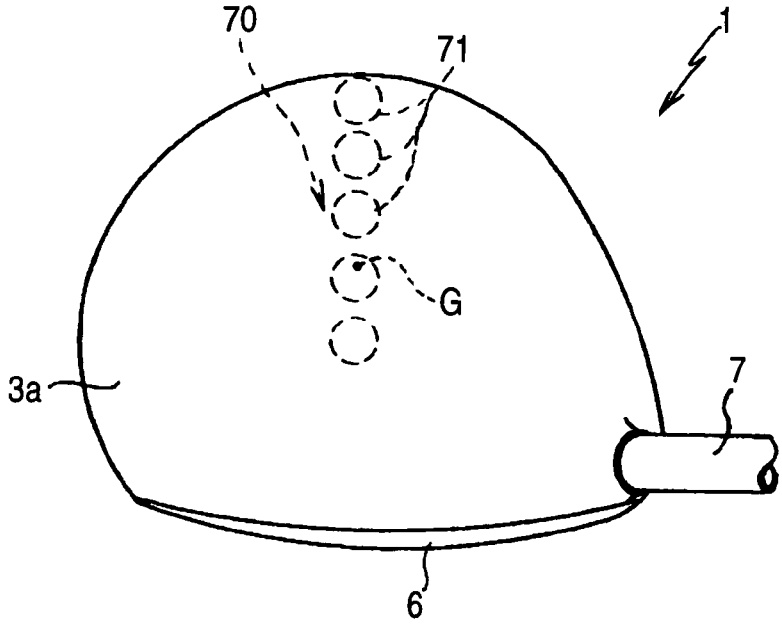
FIG. 15 is a drawing illustrating a third modification of the invention.

Furthermore, the weight-massed portion only has to be formed in such a manner as to extend in the face-to-back direction of the head, and for example, as shown in FIG. 15, a weight-massed portion 70 may be made by arranging a number of weight bodies 71 in such a manner as to be adjacent to one another in a certain direction. In this case, each weight body 71 may be fixedly held on a back side of the shell structure of the head body through welding or bonding or may be formed as an integral part of the shell structure through molding.

Fifth Embodiment

Figure 16:
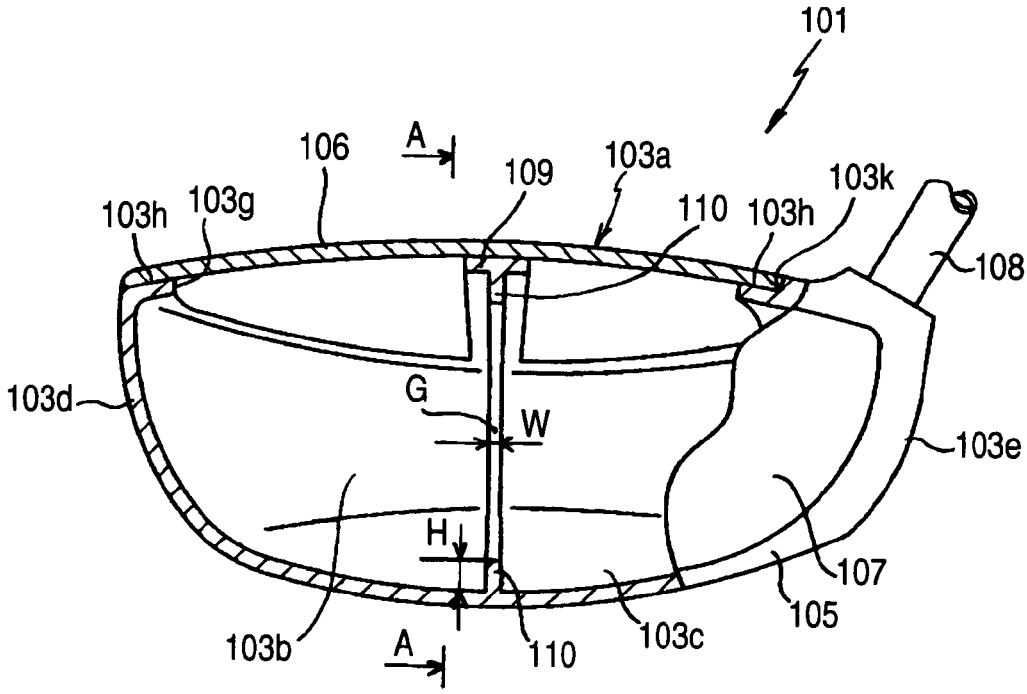
FIG. 16 is a drawing illustrating a fifth embodiment of a golf club head according to the invention, which is a transverse sectional view, taken on a face side of a head body.
Figure 17:
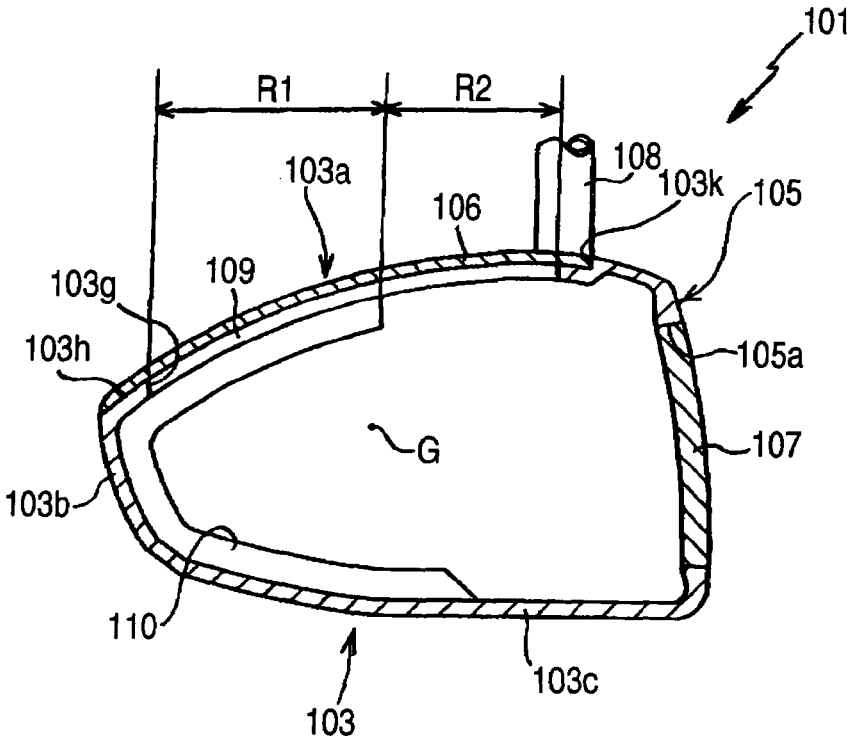
FIG. 17 is a sectional view taken along the line A-A of the head body shown in FIG. 16.
Figure 18:
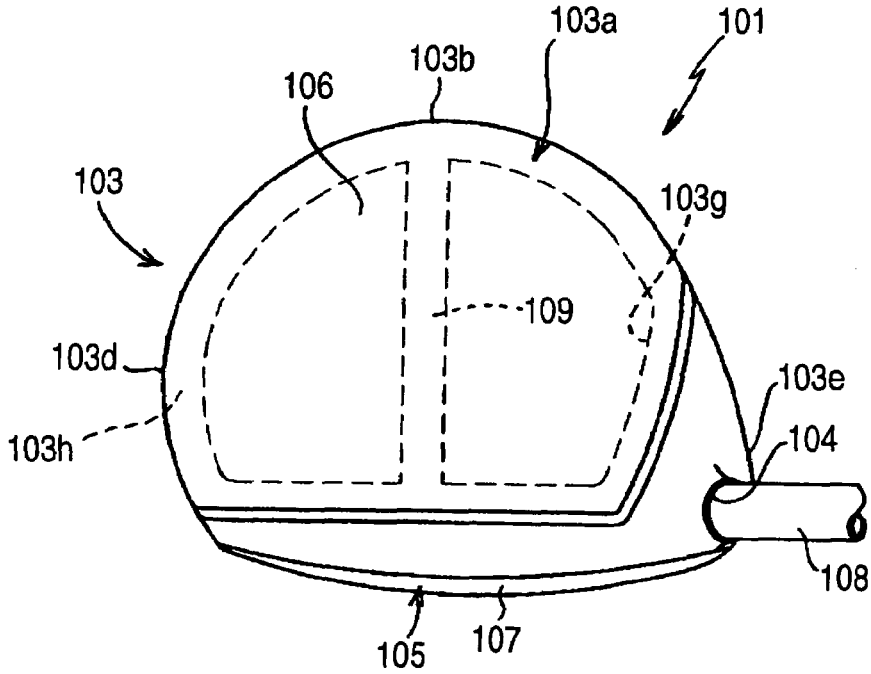
FIG. 18 is a plan view of the head body shown in FIG. 17.
Figure 19:
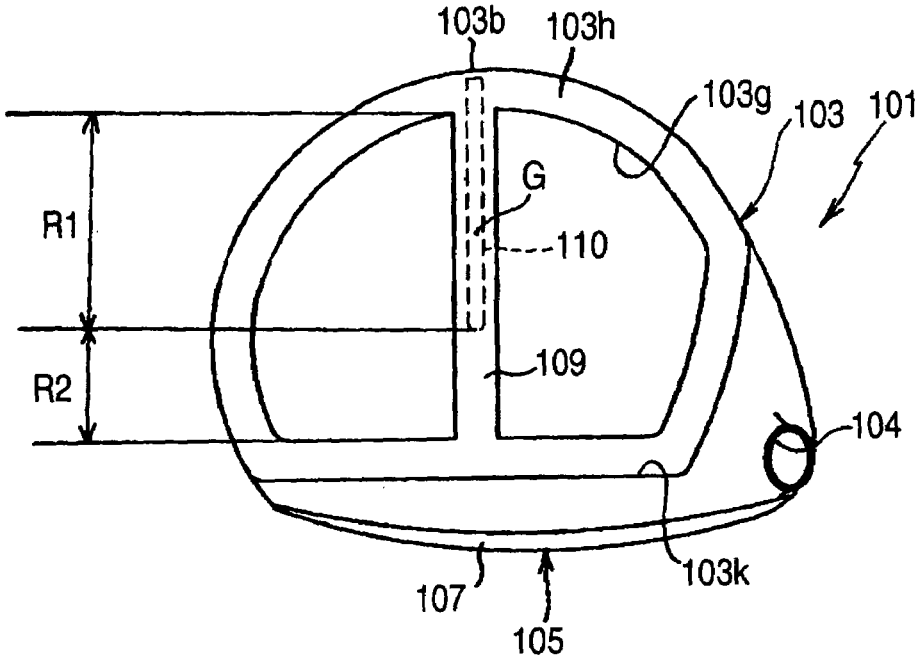
FIG. 19 is a plan view of the head body shown in FIG. 18 which illustrates a state in which a crown portion is removed.

FIGS. 16 to 19 are drawings illustrating a fifth embodiment of a golf club head according to the invention, in which FIG. 16 is a transverse sectional view of a head body, taken on a face side of the head body, FIG. 17 is a sectional view taken along the line A-A of the head body shown in FIG. 16, FIG. 18 is a plan view of the head body shown in FIG. 16, and FIG. 19 is a plan view of the head body shown in FIG. 18 which illustrates a state in which a crown portion is removed.

A head body 101 of a golf club head (hereinafter, referred to as a head) according to the fifth embodiment is made up of a rear member 103 which is made up, in turn, of a crown portion 103*a*, a back portion 103*b*, a sole portion 103*c*, a toe portion 103*d* and a heal portion 103*e* and a front member (a face portion 105 which is welded to or integrated into the rear member 103. An opening 103*g* of a predetermined size is formed in the crown portion 103*a*, so that a plate member of a fiber-reinforced resin (hereinafter, referred to as a plate member) 106 is fixedly held in this opening via bonding, screwing or press fitting, and, additionally, an opening 105*a* is formed in the face portion 105, and a face member 107 is securely held in the opening via welding, press fitting or bonding, whereby the head body 101 is constructed into a hollow shell structure constituted by the plurality of shell members as a whole.

In addition, a shaft holding hole 104 is formed in the crown portion 103*a*, and a shaft 108, which is made of metal or FRP, is securely fitted in the shaft holding hole 104 so formed towards a hollow space in the head body 101.

All of the shell members of the head body 101 of the embodiment except for the plate member 106 and the face member 107 are molded of a material such as stainless steel, stainless steel alloy, titanium or titanium alloy into a single unit through casting. It goes without saying that any of these shell members may be formed separately for integration via welding or bonding.

The plate member 106 is formed of a fiber-reinforced resin material having a larger specific gravity than those of the other shell members. To be specific, glass or carbon whose modulus of elasticity ranges from 50 GPa to 460 GPa (5 to 46 ton/mm2) is used for the fiber-reinforced resin which constitutes the plate member 106, whereby the specific strength thereof is increased (200 to 1800 MPa) and the specific gravity of the plate member 106 so formed is set so as to be on the order of one third of the specific gravity of a metallic material used to form the other shell members. In addition, the face member 107 is formed by blanking a material having a large specific strength such as stainless steel alloy, titanium or titanium alloy.

A support portion 109 is integrally formed on the crown portion 103*a* in such a manner as to bridge the opening 103*g* while bisecting the same opening along a face-to-back direction of the head body 101. This support portion 109 is formed in such a manner as to become flush with a flat surface 103*h* formed around a perimeter of the opening 103*g*, and the plate member 106 is eventually bonded onto the support portion 109 and the flat surface 103*h*, whereby substantially the entirety of the crown portion 103*a* is constituted by the plate member so bonded. Note that a stepped portion 103*k*, which corresponds to the thickness of the plate member 106, may be formed around the periphery of the flat surface 103*h*, so that the plate member 106 is bonded onto the flat surface 103*h* while being caused to abut with the stepped portion 103*k* so formed or is press fitted in the stepped portion 103*k* to thereby increase the bonding strength.

Then, a reinforcement portion 110 is provided on the support portion 109 so as to give it a change in rigidity relative to the plate member 106 which is securely fastened to the support portion 109. This reinforcement portion 110 is constructed into a rib shape and is formed together with the support portion 109, the back portion 103*b* and the sole portion 103*c* in such a manner as to extend continuously from the support portion 109 to the back portion 103*b* and the sole portion 103*c*. Namely, the reinforcement portion 110 extends from the back portion 103*b* side to substantially a middle area of the support portion 109 caused to bridge the opening 103*g* (an area of the support portion 109 over which the reinforcement portion 110 is formed or caused to extend is indicated as R1), so that the rigidity of the rear part of the head body 101 is improved so as to reduce the loss of energy when hitting the ball, and the reinforcement portion 110 is not formed on an area forward of the middle area (an area of the support portion 109 over which the reinforcement portion 110 is not formed or caused to extend is indicated as R2) so as to facilitate the deflection of the crown portion 103*a* to thereby improve the repulsive force at the point of impact.

Note that in the opening 103*g*, the area R2 where the support portion 109 is not reinforced may be set to extend over on the order of 5 to 40 mm in order to allow the plate member 106 to deflect at the point of impact to thereby increase the repulsive force. Alternatively, a ratio occupied by R1 may be set to be on the order of 30 to 80% of the overall face-to-back length (R1+R2) of the opening 103*g*. In addition, the reinforcement portion 110 (the rib) may be formed to have a height H of on the order of 1.0 to 10.0 mm and a width W of on the order of 0.8 to 5.0 mm by paying more attention to the height H than the width W in consideration of the specific rigidity, specific strength and the like.

According to the golf club head that has been described above, the opening is formed in the crown portion 103*a*, so that the plate member 106 having a high specific strength is disposed in the opening, whereby the center of gravity of the head body 101 can be lowered, and this facilitates the deflection of the crown portion 103*a*, thereby making it possible to realize the improvement in the repulsion properties at the face portion. In this case, by increasing the ratio of the plate member 106 to the entirety of the crown portion 103*a* (the ratio of the opening 103*a* to the whole area of the crown portion 103*a*), the reduction in weight of the crown portion can be realized and hence the weight capacity can be increased, thereby making it possible to increase the degree of freedom in designing the center of gravity. Due to this, a weight body (not shown) may be disposed at any position in the interior of the head for adjusting the position of the center of gravity. In addition, by increasing the ratio of the plate member 106, the crown portion 103*a* is made to easily deflect, thereby making it possible to realize the enhancement of repulsion properties at the face portion. To be specific, the ratio at which the opening is formed so that the plate member 106 is positioned thereover or the ratio of the opening 103*g* to the crown portion 103*a* as resulting when the head body is viewed from the top as shown in FIG. 18 is preferably set to fall within a range from 30 to 90%. With a ratio of less than 30%, it becomes difficult to reduce the weight of the crown portion as required, whereas with a ratio exceeding 90%, it becomes difficult to obtain a required joining strength between the plate member 106 and the head body 101.

In addition, since the plate member 106 is supported by the support portion 109 which is made to bridge the opening in such a manner as to divide the same opening, the number of joining surfaces is increased to thereby stabilize the support conditions, and vibrations are made difficult to be damped, whereby the improvement in hitting feeling can be realized and a better hitting sound can be obtained. Then, while the reinforcement portion 110 is formed integrally on the support portion 109 to thereby reinforce the support portion 109, since no reinforcement is imparted on the face side of the head body 101 but the back side thereof is reinforced, the head body 101 is made to deflect easily on the face side, whereby the loss of energy at the point of impact can be reduced, thereby making it possible to realize the improvement in driving distance of the ball. The reduction in the loss of energy is an effect to reduce the deformation amount of the ball to thereby reduce the vibration energy of the ball as a result of the increase in the deformation on the face side to thereby increase the deflection amount of the face.

In particular, in the construction described above, since the rib, which constitutes the reinforcement portion 110, is formed in such a manner as to extend from the back portion 103*b* to the sole portion 103*c*, the rigidity of the rear part of the head body is increased, whereby the loss of energy at the time of hitting the ball is made to be reduced. In this case, for the same reason as that explained as to the crown portion side, the reinforcement portion 110 is preferably terminated in the vicinity of a central area of the sole portion 103*c* so as to facilitate the deflection of a portion of the head body 101 which is situated just behind the face portion. In addition, the sole portion 103*c* is preferably made to be thinner than the thickness of the face member 107 which is securely held at the face portion 105. By adopting the construction like this, the sole portion 103*c* is also made to deflect easily, and the deflection of the sole portion is made to occur concentratedly in an area facing the face portion, thereby making it possible to realize the improvement in repulsion properties.

Furthermore, in the construction described above, since the reinforcement portion 110 is formed into the rib shape and has the predetermined height and thickness, the reinforcement portion 110 so formed is imparted a function as the weight-massed portion where the heavy weight is massed relative to the peripheral portion thereof. Namely, since such a weight-massed portion is provided in such a manner as to extend in the direction of the swing plane, the feeling of heavy weight can be felt in the extending direction during the swing, whereby the direction of the face side can be easily sensed by the player, and hence the hitting point is made difficult to scatter. In particular, since the rotation of the shaft about the shaft axis is made to easily follow the inertial force exerted in the direction of the swing plane without any additional operation by forming the reinforcement portion 110 like that close to the position which passes through the center of gravity G of the head (within a range of on the order of +/−10 mm), the swing can be stabilized, whereby the square alignment of the clubface to the ball can be facilitated at the point of impact and hence the direction of the ball hit can be stabilized. Furthermore, since the reinforcement portion 110 where the heavy weight is concentrated becomes easy to be sensed by the player, there is provided an advantage the hitting point is hard to scatter in the toe-to-heel direction. In addition, by forming the reinforcement portion 110 where the heavy weight is concentrated in such a manner as to extend from the crown portion 103*a* to the sole portion 103*c*, the vertical (crown-to-sole direction) balance of the head is improved, whereby the shaft rotation is made to follow the swing plane more easily. At the same time, since a vertical inertial moment about the center of gravity is also increased, there can be provided a golf club which is superior in dealing with the vertical deflection of the hitting point.

Sixth Embodiment

Figure 20:
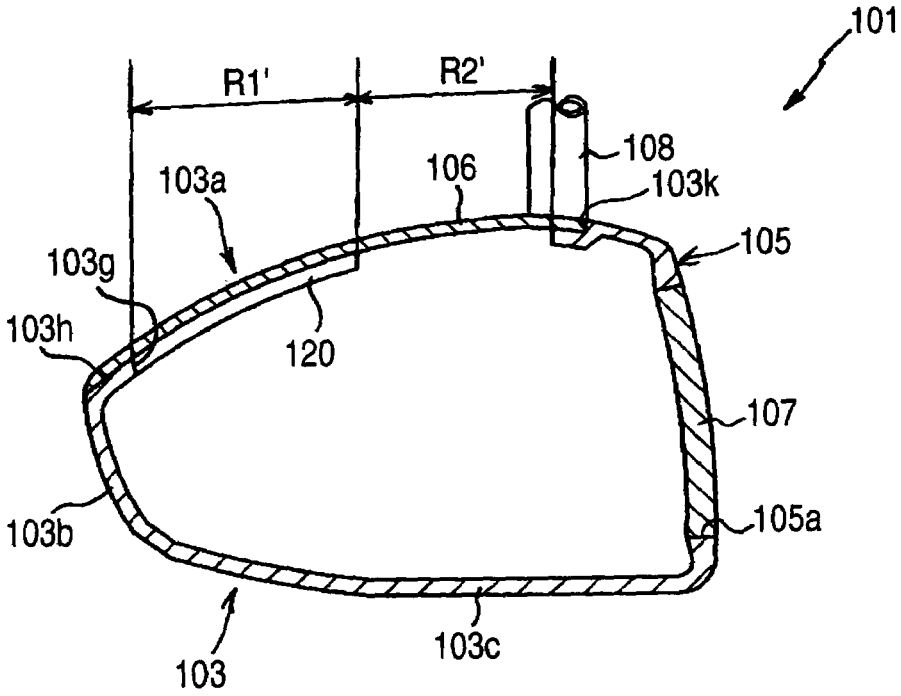
FIG. 20 is a drawing illustrating a sixth embodiment of the invention, which is a longitudinal sectional view of a head body.
Figure 21:
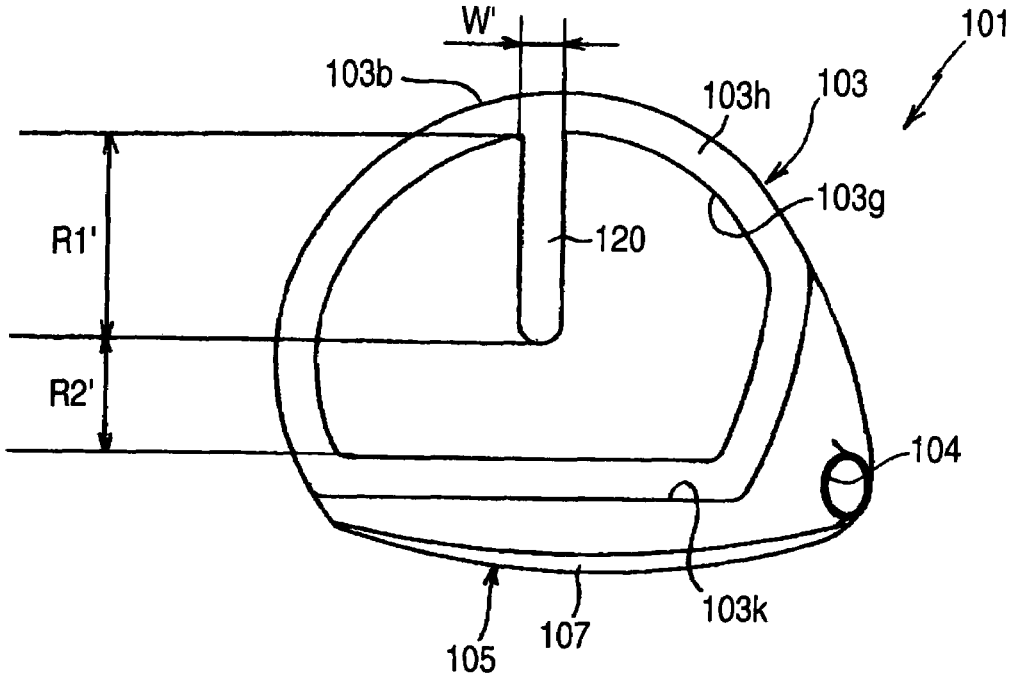
FIG. 21 is a plan view of the head body shown in FIG. 20 which illustrates a state in which a crown portion (a plate member) is removed.

FIGS. 20 and 21 are drawing illustrating a sixth embodiment of the invention, in which FIG. 20 is a longitudinal sectional view of a head of the sixth embodiment of the invention, and FIG. 21 is a plan view thereof with a plate member being removed therefrom.

This embodiment is such that the support portion in the fifth embodiment is made to obtain the function as the reinforcement portion without any modification, and hence, in this embodiment, a support portion 120 (a reinforcement portion) is formed together with a shell member in such a manner as to extend from a back portion side towards a face portion side. The support portion 120 bisects an opening 103 formed in a crown portion transversely symmetrically along the face-to-back direction and is terminated at substantially a middle area of the opening 103*g*. An area R1' where the support portion 120 is formed in that way supports a plate member 106 and increases the rigidity of a part of the plate member 106 which constitutes a rear part of a head body 101, whereby the loss of energy at the point of impact is reduced. An area R2' situated forward of the area R1' where the support portion 120 is not formed does not support the plate member 106 so as to facilitate the deflection of the plate member 106, so that the repulsion properties at the point of impact is improved.

In this construction, by providing the area R2' where the plate member 106 is not reinforced in such a manner as to extend over on the order of 5 to 40 mm, the plate member 106 is allowed to deflect at the time of impact to thereby enhance the repulsive force. Alternatively, the ratio of R1' may be set to on the order of 30 to 80% of the overall length (R1'+R2') of the opening 103*g* in the face-to-back direction. In addition, the support portion 120 may only have to be formed wide (a width W' of on the order of 5 to 20 mm), when compared with that of the reinforcement portion 110 of the embodiment described above, in order to obtain the support and reinforcement effects.

According to the construction like this, the same effect as that of the embodiments described above can be obtained, and the construction can be simplified, thereby making it possible to reduce the production costs. Of course, also in this embodiment, a rib may be formed along the support portion in order to enhance the reinforcement effect, or the reinforcement portion may be formed in such a manner as to extend as far as a sole portion. In addition, in order to enhance the repulsion effect at the face portion, the thickness of the sole portion is preferably made to be smaller than the thickness of a face member 107.

Seventh Embodiment

Figure 22:
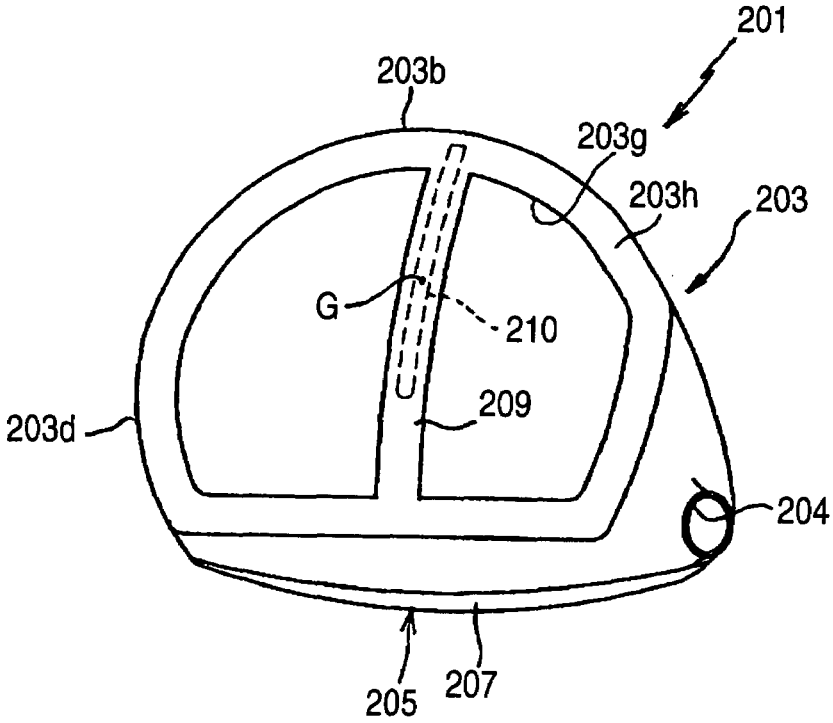
FIG. 22 is a drawing illustrating a seventh embodiment of the invention, which is a plan view of a head body showing a state in which a crown portion (a plate member) is removed.

FIG. 22 is a drawing illustrating a seventh embodiment of the invention, which is a plan view of a head with a plate member being removed therefrom.

In this embodiment, the support portion 109 and the reinforcement portion 110 in the fifth embodiment are made to curve along the swing plane when looking at a head body 101 from the top. Since a portion where the heavy weight is massed is made to follow the swing plane direction during the swing by forming a support portion 109 and a reinforcement portion 110 in such a manner as to curve in that way, the effect to make the shaft rotation follow the swing plane direction is enhanced, whereby a swing becomes possible which is difficult to deflect and stable. In this case, the radius of curvature of the support portion 109 and the reinforcement portion 110 may only have to be set to fall within a range of 500 to 2000 mm in consideration of a difference in swing plane depending upon players.

Note that in this construction, as has been described above, the support portion 109 and the reinforcement portion 110 are preferably formed so as to be close to the position which passes through the center of gravity G of the head. In addition, this construction can be applied to the sixth embodiment.

Thus, while the embodiments of the invention have been described, the invention is not limited thereto but may be modified appropriately with respect to the construction of the support portion and the reinforcement portion, provided that in forming the opening in the crown portion of the head body of a hollow shell construction so that the plate member of a fiber-reinforced resin is mounted therein, the support portion and the reinforcement portion are allowed to support and reinforce the plate member on the back side thereof to impart rigidity to the relevant portion of the plate member, as well as providing no reinforcement for the face side of the plate member to allow the relevant portion of the plate member to deflect effectively. For example, while, in any of the embodiments, the support portion and the reinforcement portion are formed in such a manner as to bisect the opening transversely symmetrically, a construction may be possible in which the opening is divided into three or four portions (equally or not equally). In addition, a rib like one described in the fifth embodiment does not always have to be provided in the event that an effective reinforcement can be attained only by the support portion.

Furthermore, in the invention, the overall shape, material and method of forming the head body can be modified variously. For example, the support portions and the reinforcement portions in the aforesaid embodiments may be such as to be molded together with the shell members of the head main bodies, respectively, or be molded as separate members so that they are securely held in the head main bodies, respectively, via bonding or the like.

Eighth Embodiment

Figure 23:
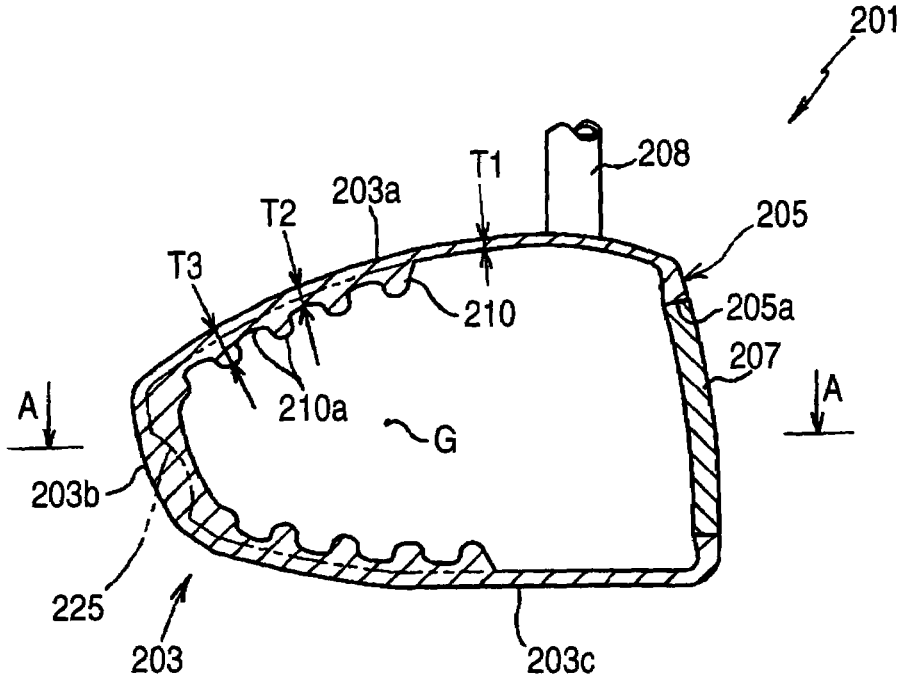
FIG. 23 is a drawing illustrating an eighth embodiment of a golf club head according to the invention, which is a longitudinal sectional view of a head body.
Figure 24:
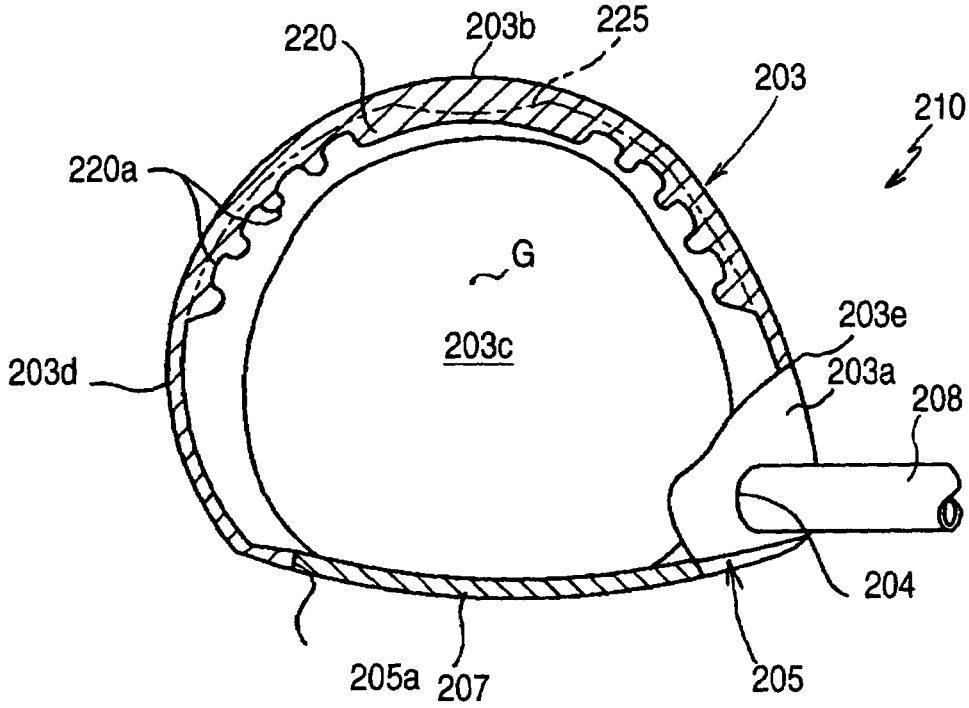
FIG. 24 is a sectional view taken along the line A-A of the head body shown in FIG. 23.
Figure 25:
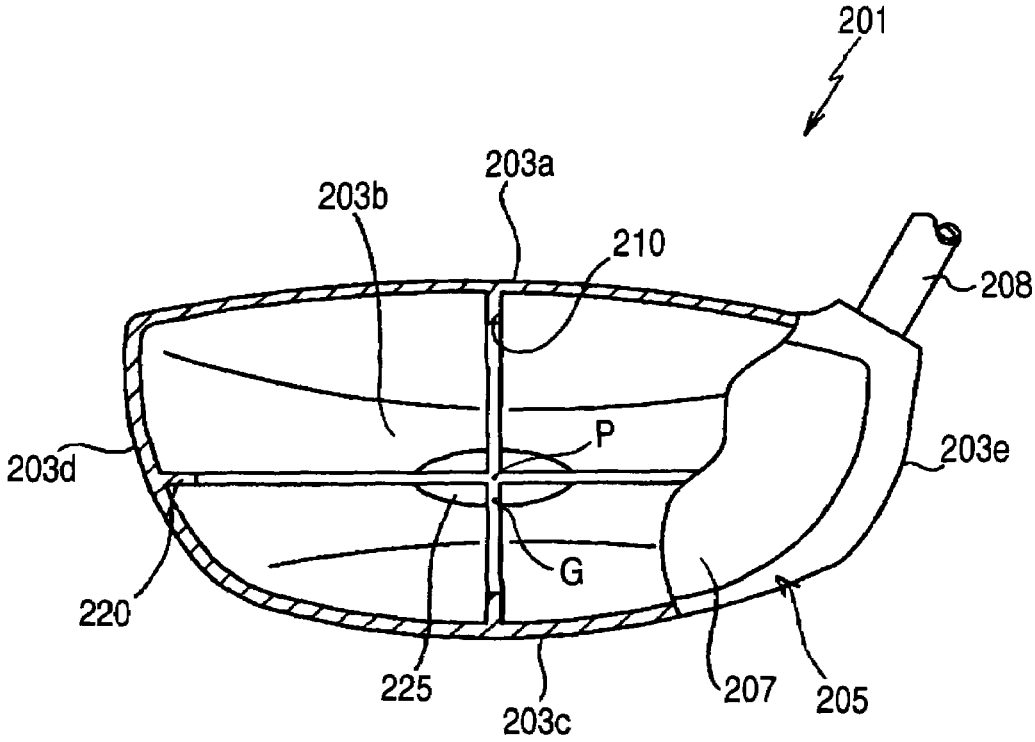
FIG. 25 is a transverse sectional view of the head body shown in FIG. 23, taken on a face side thereof.

FIGS. 23 to 25 are drawings illustrating an eighth embodiment of a golf club head according to the invention, in which FIG. 23 is a longitudinal sectional view of a head body, FIG. 24 is a sectional view taken along the line A-A of the head body shown in FIG. 23, and FIG. 25 is a transverse sectional view of the head body.

Ahead body 201 of a golf club head (hereinafter, referred to as a head) according to the eighth embodiment is made up of a rear member 203 which is made up, in turn, of a crown portion 203*a*, a back portion 203*b*, a sole portion 203*c*, a toe portion 203*d* and a heal portion 203*e* and a front member (a face portion) 205 which is welded to or integrated into the rear member 103. An opening 205*a* is formed in the face portion 205, so that a face member 207 is securely held in the opening via welding, press fitting or bonding, whereby the head body 201 is constructed into a hollow shell structure constituted by the plurality of shell members as a whole.

In addition, a shaft holding hole 204 is formed in the crown portion 203*a*, and a shaft 208, which is made of metal or FRP, is securely fitted in the shaft holding hole 204 so formed towards a hollow space in the head body 201.

All of the shell members of the head body 201 of the embodiment except for the face member 207 are molded of a material such as stainless steel, stainless steel alloy, titanium or titanium alloy into a single unit through casting. It goes without saying that any of these shell members may be formed separately for integration via welding or bonding. In addition, the face member 207 is formed by blanking a material having a great specific strength such as stainless steel alloy, titanium or titanium alloy.

A rib-shaped protruding portion 210 is provided over the crown portion 203*a*, the back portion 203*b* and the sole portion 203*c* in such a manner as to extend in a direction which intersects with the face portion 205 at substantially right angles. By adopting this construction, there is no case where the protruding portion 210 is deformed by virtue of an impact generated when hitting the ball in a transverse direction (a twisted direction relative to a face) relative to the protruding direction, whereby the transmission efficiency of energy to the ball hit is improved, and the repulsive force is hence improved. In addition, in the case of this embodiment, the protruding portion 210 is formed continuously from the crown portion 203*a* to the back portion 203*b* and the sole portion 203*c* together with these shell members in such a manner as to extend from the back portion 203*b* side, respectively, towards the crown portion 203*a* and the sole portion 203*c* so as to be terminated at substantially middle areas thereof. Namely, the protruding portion 210 is formed such that the rigidity of a rear part of the head body 201 is increased so as to reduce the energy loss at the time of hitting the ball, whereas the protruding portion 210 is not formed on the crown portion 203*a* and the sole portion 203*c* over areas situated forward of substantially the middle areas thereof so as to facilitate the defection of the crown portion 203*a* and the sole portion 203*c* on face sides thereof to thereby enhance the repulsive force at the point of impact.

A series of indented and raised portions or a continuous irregular portion 210*a* is formed along an edge of the protruding portion 210 so as to facilitate cutting work. This irregular portion 210*a* is such as to be intended to implement a weight adjustment of the head by cutting any of continuously formed raised portions and may be formed to realize a relation of $T1 < \leqq T2 < T3$, assuming that the thickness of the shell member (the crown portion 203*a*) is T1, the thickness at the indented portion is T2 and the thickness at the raised portion is T3. In addition, forming the raised portions at regular intervals (pitches) increases the productivity and facilitates the identification of a cutting position. Note that the dimension of T3 is preferably on the order of 4.0 to 15 mm. This is because in the event that the dimension is less than 4.0 mm, a resulting cutting area for weight adjustment becomes too small, whereas in the event that the dimension exceeds 15 mm, the generation of vibration noise (beat noise) is facilitated when the ball is hit. In addition, the difference between T3 and T2 is preferably 2 mm or greater. This is because with the difference being less than 2 mm, it becomes difficult to implement the cutting with good accuracy.

The protruding portion 210 on which the irregular portion 210*a* is formed is such as to enable the adjustment of the position of the center of gravity G as a matter of course, and by forming the protruding portion 210 in such a manner as to extend long in a rib-shaped fashion, the position of the center of gravity G can be adjusted over a wide range with good accuracy. Namely, the protruding portion 210 formed over the crown portion, the back portion and the sole portion has a function to adjust the position of the center of gravity G vertically and in the face-to-back direction. The thickness of the rib of the protruding portion is preferably thicker than T1, and to be specific, it is preferably in a range of 1.2 to 5.0 mm. This is because in the event that the thickness is set to be less than 2 mm, the vibration noise (beat noise) becomes easy to be generated when the ball is hit due to the lack of rigidity, whereas in the event that the thickness exceeds 5.0 mm, too much the weight is concentrated in the relevant area, resulting in a head having a bad balance in terms of weight.

In addition, in this embodiment, a protruding portion 220 having a similar irregular portion 220*a* is formed in such a manner as to extend forwards from the back portion 203*b* to substantially middle portions of the toe portion 203*d* and the heel portion 203*e*, respectively. As with the protruding portion 210, the protruding portion 220 is such as to be intended to enable the adjustment of the position of the center of gravity G as a matter of course, and by forming the protruding portion 220 in such a manner as to extend long in a rib-shaped fashion, the position of the center of gravity G can be adjusted over a wide range with good accuracy. Namely, the protruding portion 220 formed over the toe portion, the back portion and the heel portion has a function to adjust the position of the center of gravity G in the toe-to-heel direction, as well as in the face-to-back direction.

Note that the protruding portion 220 is continuously formed together with the shell members, and by being formed in such a manner as to extend to substantially the middle portions of the toe portion 203*d* and the heel portion 203*e*, respectively, as with the protruding portion 210, the protruding portion 220 increases the rigidity at the rear part of the head body 201 to thereby reduce the loss of energy at the time of hitting the ball, while enabling the toe portion 203*d* and the heel portion 203*e* to deflect easily on the face sides thereof to thereby increase the repulsive force at the point of impact. In addition, the thickness of the rib at the raised portion of the irregular portions 210*a*, 220*a* may be thinner or equal to the thickness of the rib at the indented portion. This is because in the event that the raised portion is made thinner, the beat noise is easily generated, and on the contrary, in the event that raised portion is made thicker, the cutting becomes difficult.

There is no limitation on the positions where the protruding portions 210, 220 are formed, but, forming them at positions which pass through a geometric center P of the head as shown in FIG. 25 enables an adjustment of the center of gravity to be carried out as intended. In addition, since the feel of heavy weight comes to be felt more at the geometric center of the head, the deflection of the hitting point is reduced.

According to the golf club head as has been described above, by disposing the protruding portions 210, 220 each having the irregular portion in the interior of the head body, the adjustment of the weight balance and the position of the center of gravity can be facilitated when forming a head. Namely, when fabricating a head by welding the shell members together, the head can be formed with good accuracy and optimal weight balance by cutting any of the raised portions of the irregular portions formed on the protruding portions 210, 220, respectively.

To be specific, by cutting the raised portion or portions at any position or positions on the protruding portion 210, the position of the center of gravity can be adjusted vertically, as well as in the face-to-back direction, whereas by cutting the raised portion or portions at any position or positions on the protruding portion 220, the position of the center of gravity can be adjusted in the toe-to-heel direction, as well as in the face-to-back direction, whereby the position of the center of gravity can be adjusted throughout 360 degrees with good accuracy and ease. Furthermore, since the portions to be cut reside in the interior of the head, the external appearance of the head does not have to be damaged, and moreover, since the portions to be cut are constituted by the raised portions (or have the indented portions), there is no risk that the inertial moment is reduced largely.

Then, the protruding portions 210, 220 that have been described above have the function as the weight-massed portion where the heavy weight is massed. Namely, the protruding portions 210, 220 have a function to improve the balance of swing irrespective of the necessity of cutting, in addition to the function to implement the weight adjustment. For example, since the protruding portion 210 that is constructed as has been described above is formed in such a manner as to extend along the swing plane direction which is a direction normal to the face portion, the feeling of heavy weight can be obtained along the extending direction during the swing, so that the orientation of the face side can easily be sensed by the player, the hitting point being thereby made difficult to scatter.

In particular, since the rotation of the shaft about the shaft axis can easily be made to follow the inertial force exerted in the swing plane direction without any additional operation by forming such a reinforcement portion in the vicinity of the position which passes through the center of gravity G of the head, the swing can be stabilized, whereby the square alignment of the clubface to the ball can be facilitated at the point of impact and hence the direction of the ball hit can be stabilized. In addition, by forming the reinforcement portion where the heavy weight is massed in such a manner as to extend from the crown portion 203*a* to the sole portion 203*c*, the vertical balance (the balance in the crown-to-sole direction) can be improved, whereby the swing becomes difficult to deflect and easy to follow the swing plane direction.

In addition, the protruding portions 210, 220 are preferably designed to be substantially at right angles relative to the face side. By adopting this construction, there is eliminated a risk that the protruding portions 210, 220 is deformed in the transverse direction (in the twisted direction) by virtue an impact generated when the ball is hit, whereby the transmission efficiency of energy to the ball hit is increased.

Note that a weight portion 225 may be disposed appropriately in the interior of the head body for adjustment of the weight of the head.

Ninth Embodiment

Figure 26:
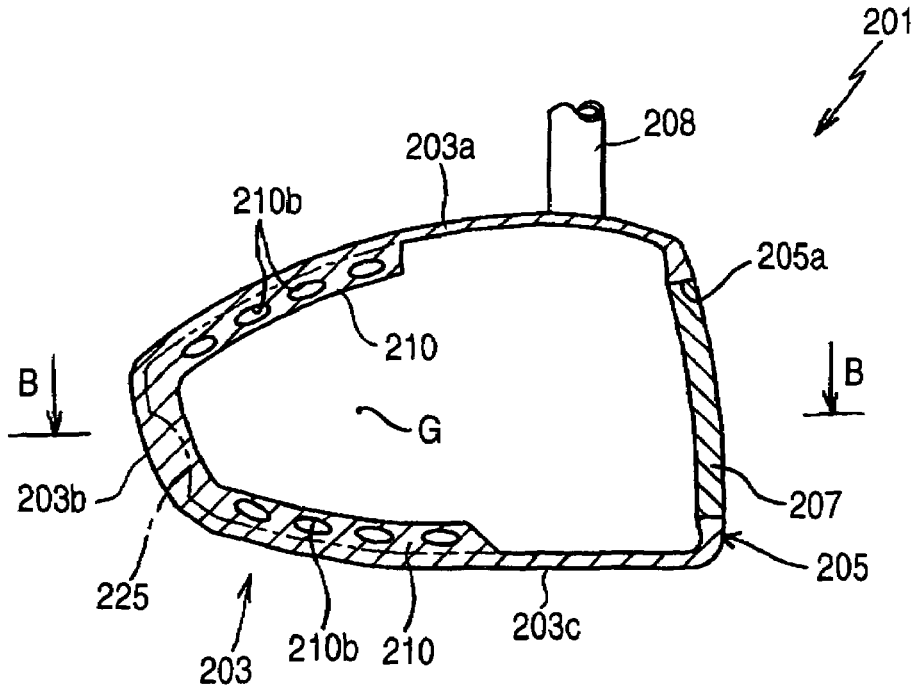
FIG. 26 is a drawing illustrating a ninth embodiment according to the invention, which is a longitudinal sectional view of a head body.
Figure 27:
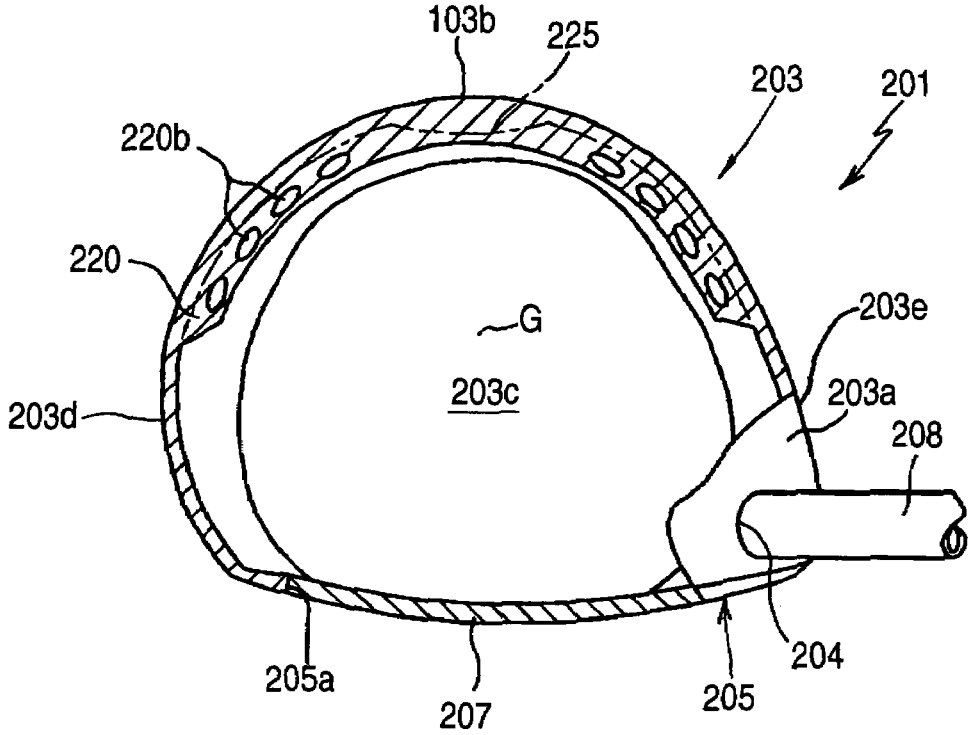
FIG. 27 is a sectional view taken along the line B-B of the head body shown in FIG. 26.

FIGS. 26 and 27 are drawings illustrating a ninth embodiment of the invention, in which FIG. 26 is a longitudinal sectional view of a head body and FIG. 27 is a sectional view taken along the line B-B of the head body shown in FIG. 26.

In this embodiment, hole portions 210*b*, 220*b* are formed in place of the irregular portions, respectively, formed on the protruding portions 210, 220 which are described in the eighth embodiment above. Forming these hole portions also facilitates cutting or the like, whereby the adjustment of weight balance can be implemented with good accuracy. In particular, cutting the hole portions using a drill or a router can provide a good accuracy. Note that the holes that are so formed may come in different sizes; large or small, or the hole portions may be combined with the irregular portions described above. In addition, it is possible to mount a weight component by making use of the hole portion or portions, and the mounting of such a weight component can be ensured by virtue of welding or screwing.

Tenth Embodiment

Figure 28:
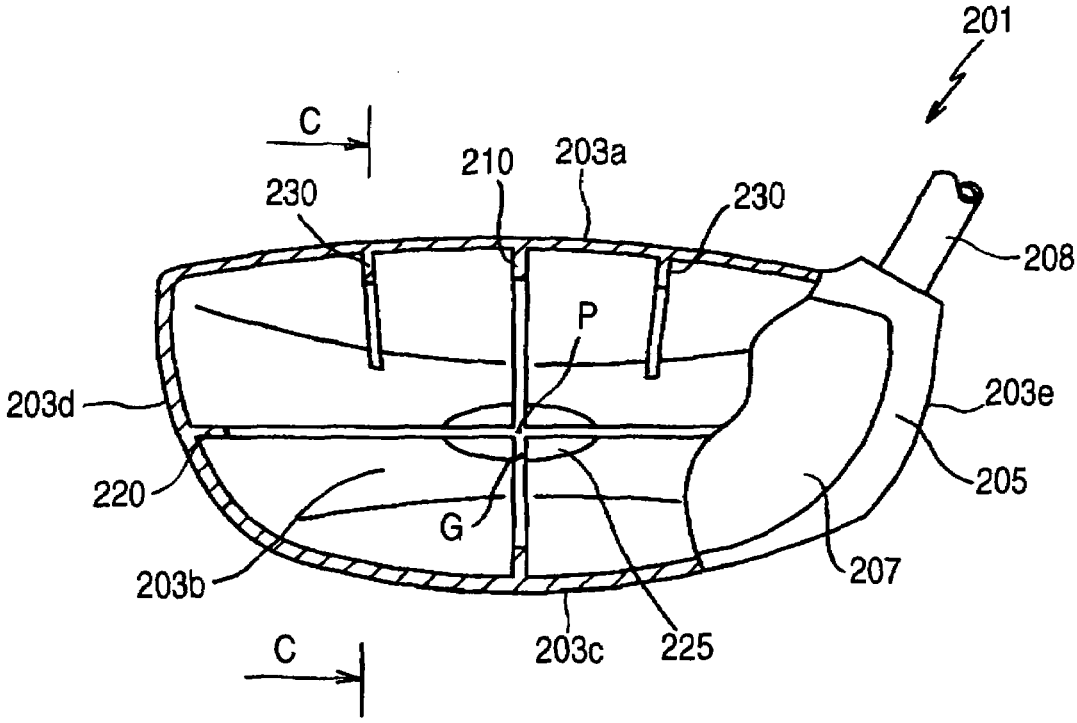
FIG. 28 is a drawing illustrating a tenth embodiment according to the invention, which is a longitudinal sectional view of a head body.
Figure 29:
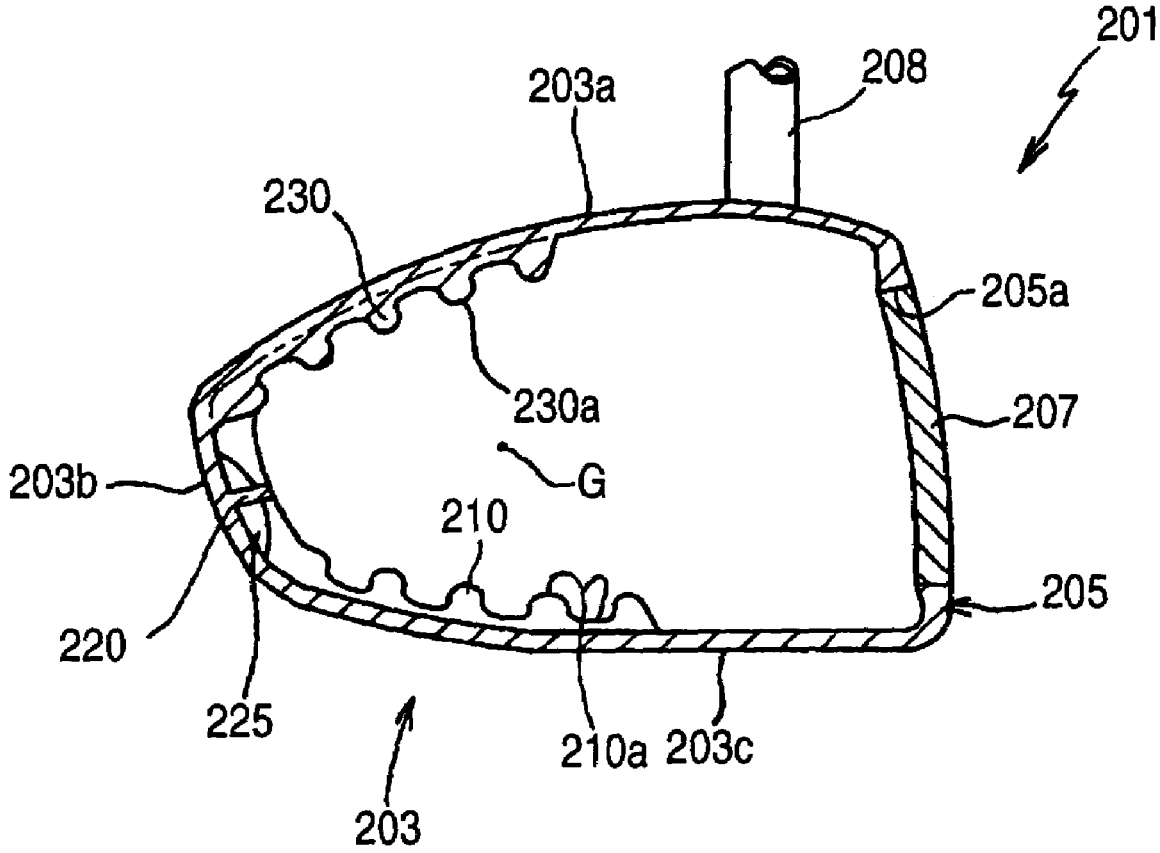
FIG. 29 is a sectional view taken along the line C-C of the head body shown in FIG. 28.

FIGS. 28 and 29 are drawings illustrating a tenth embodiment of the invention, in which FIG. 28 a longitudinal sectional view of a head body and FIG. 29 is a sectional view taken along the line C-C of the head body shown in FIG. 8.

While in the embodiments, the protruding portion formed in such a manner as to extend over the crown portion, the back portion and the sole portion is so provided at the single location, and the protruding portion formed in such a manner as to extend along the toe portion, the back portion and the heel portion is so provided at the single location, these protruding portions may be disposed at any positions within the head body. For example, a protruding portion 230 having an irregular portion 230*a* may be formed further on the crown portion along each side of the protruding portion 210. Namely, since they are portions where the heavy weight is massed relative to the peripheral portions of the shell members, the protruding portions may be disposed in advance at various positions which can realize the improvement in weight balance and swing balance.

Thus, while the embodiments of the invention have been described heretofore, the invention is not limited thereto but may be such that the protruding portion or portions are formed in the interior of the head body of a hollow shell construction and that the irregular portion or hole portions are formed on or in the protruding portion or portions, and the invention can be modified variously with respect to the overall shape, material and method of forming the head body without being limited to the specific examples illustrated in the embodiments. In addition, the position, length, thickness and height of the protruding portion or portions that are formed in the interior of the head body, the shape (height, pitch and the like) of the irregular portion formed on the protruding portion or portions and the position, number and size of the hole portion that is formed in the protruding portion or portions can be modified appropriately, as well.

What is claimed is:

1. A golf club head comprising:

a hollow shell head body that defines a face portion for hitting a ball and a crown portion; and a weight-massed portion formed on at least said crown portion, wherein the weight-massed portion extends in a face-to-back direction of the head body and includes a greater mass than a mass of a peripheral portion of the head body, wherein the weight-massed portion is disposed from the crown portion to a sole portion, and wherein a length of the weight-massed portion as measured in the face-to-back direction on the crown portion corresponds to one third of a length of the crown portion as measured in the face-to-back direction.

2. The golf club head according to claim 1, wherein the weight-massed portion is disposed 5 mm or more rearward of a point of inflection between the crown portion and the face portion.

3. The golf club head according to claim 1, wherein the weight-massed portion is disposed in such a manner as to follow a lie angle.

4. The golf club head according to claim 1, wherein the weight-massed portion is disposed to protrude towards a hollow space in the head body.

5. The golf club head according to claim 4, wherein hole portions are disposed in the weight-massed portion.

6. The golf club head according to claim 1, wherein the weight-massed portion is disposed in such a manner as to curve to follow a swing plane when viewing the head body from the top thereof.

7. A golf club head comprising:

a hollow shell head body that defines a face portion for hitting a ball, a crown portion including an opening, and a back portion;

a fiber-reinforced resin plate that closes the opening;

a support portion that bridges the opening to divide the opening in a face-to-back direction of the head body, and supports the fiber-reinforced resin plate;

a reinforcement portion that is disposed at the support portion to extend from the back portion toward a vicinity of a center area of the opening and reinforces the fiber-reinforced resin plate, and a rib integrally formed with the support portion, wherein the rib extends from the support portion toward a center area of a sole portion.

8. The golf club head according to claim 7, wherein the reinforcement portion is disposed in such a manner as to curve to follow a swing plane when viewing the head body from the top thereof.

9. A golf club head comprising:

a hollow shell head body that defines a face portion for hitting a ball, a crown portion including an opening, and a back portion;

a fiber-reinforced resin plate that closes the opening; and a reinforcement portion that divides the opening in a face-to-back direction of the head body, extends from the back portion toward a vicinity of a center area of the opening and supports the fiber-reinforced resin plate, wherein said reinforcement portion has a support portion and a rib-shaped protrusion inwardly extending from the support portion.

10. The golf club head according to claim 9, wherein a face member is disposed in the face portion and a thickness of a sole portion of the head body is smaller than that of the face member.

11. A golf club head comprising:

a hollow shell head body that defines a face portion for hitting a ball, and a crown portion; and a rib-shaped protruding portion that is disposed inside the head body, wherein the protruding portion includes indented portions, raised portions and a through hole, wherein the rib-shaped protruding portion is disposed continuously from the crown portion to a sole portion.

12. A golf club head comprising:

a hollow shell head body that defines a face portion for hitting a ball and a crown portion; and a weight-massed portion that is disposed on at least said crown portion, wherein the weight-massed portion extends in a face-to-back direction of the head body and includes a larger mass than a mass of a peripheral portion of the head body, wherein the weight-massed portion is disposed continuously from the crown portion to a sole portion, wherein the weight-massed portion is disposed in such a manner as to follow a lie angle.

13. The golf club head according to claim 12, wherein the weight-massed portion is disposed to protrude towards a hollow space in the head body.

14. The golf club head according to claim 12, wherein a plurality of hole portions are formed in the weight-massed portion.

15. A golf club head comprising:

a hollow shell head body that defines a face portion for hitting a ball, a crown portion including an opening, and a back portion;

a fiber-reinforced resin plate that closes the opening; and a reinforcement portion that is disposed to extend from the back portion toward a vicinity of a center area of the opening and reinforces the fiber-reinforced resin plate, wherein the reinforced portion is disposed continuously from the crown portion to a sole portion.

* * * * *